US011166578B2

(12) United States Patent
Mackenzie

(10) Patent No.: US 11,166,578 B2
(45) Date of Patent: Nov. 9, 2021

(54) CLOTHES HANGERS

(71) Applicant: Norman Fraser Mackenzie, Manchester (GB)

(72) Inventor: Norman Fraser Mackenzie, Manchester (GB)

( * ) Notice: Subject to any disclaimer, the term of this patent is extended or adjusted under 35 U.S.C. 154(b) by 114 days.

(21) Appl. No.: 16/317,058

(22) PCT Filed: Jul. 11, 2017

(86) PCT No.: PCT/EP2017/067453
§ 371 (c)(1),
(2) Date: Jan. 11, 2019

(87) PCT Pub. No.: WO2018/028914
PCT Pub. Date: Feb. 15, 2018

(65) Prior Publication Data

US 2019/0298093 A1 Oct. 3, 2019

(30) Foreign Application Priority Data

| | | |
|---|---|---|
| Jul. 13, 2016 | (GB) | 1612173 |
| Apr. 8, 2017 | (GB) | 1705698 |
| May 2, 2017 | (GB) | 1706923 |
| May 19, 2017 | (GB) | 1708061 |

(51) Int. Cl.
*A47G 25/20* (2006.01)
*A47G 25/36* (2006.01)
*A47G 25/38* (2006.01)

(52) U.S. Cl.
CPC ..... *A47G 25/20* (2013.01); *A47G 25/36* (2013.01); *A47G 25/38* (2013.01)

(58) Field of Classification Search
CPC ..... A47G 25/20; A47G 25/36; A47G 25/38; A47G 25/14; A47G 25/1407–1442; A47G 25/26; A47G 25/28–30; A47G 25/48; A47G 25/60
See application file for complete search history.

(56) References Cited

U.S. PATENT DOCUMENTS

| | | | | |
|---|---|---|---|---|
| 2,481,737 | A | | 9/1949 | Gartner |
| 2,675,948 | A | * | 4/1954 | Mallory |
| 3,406,881 | A | * | 10/1968 | Batts |
| 5,137,191 | A | * | 8/1992 | Blanchard et al. |
| D369,908 | S | * | 5/1996 | Pfutzenreuter |
| 5,718,362 | A | * | 2/1998 | Silverman |
| 6,070,772 | A | | 6/2000 | Bond |
| 6,138,880 | A | * | 10/2000 | Williams |
| 6,688,503 | B2 | * | 2/2004 | Vlazanko et al. |
| 6,817,497 | B2 | * | 11/2004 | Grasso et al. |
| 7,124,920 | B2 | * | 10/2006 | Gustafson et al. |
| 8,292,135 | B1 | * | 10/2012 | Schorn |

(Continued)

FOREIGN PATENT DOCUMENTS

WO WO 2015/015139 A2 * 2/2015

*Primary Examiner* — Ismael Izaguirre
(74) *Attorney, Agent, or Firm* — Rumit Ranjit Kanakia

(57) ABSTRACT

Developments relating to clothes hangers comprising a series of methods to bring increased width and contoured arms to substantially planar clothes hangers, by creating designs whereby an ecologically friendly material such as paper and cardboard may assume a similar strength to plastic or wood, and ways of attaching a wire-based hook to a planar clothes hanger.

7 Claims, 21 Drawing Sheets

(56) References Cited

U.S. PATENT DOCUMENTS

| | | | |
|---|---|---|---|
| D762,993 | S * | 8/2016 | Vaaderpass |
| 2004/0084488 | A1 | 5/2004 | Gustafson et al. |
| 2011/0089202 | A1* | 4/2011 | Pakzad et al. |
| 2012/0118921 | A1* | 5/2012 | Mackenzie |

* cited by examiner

3

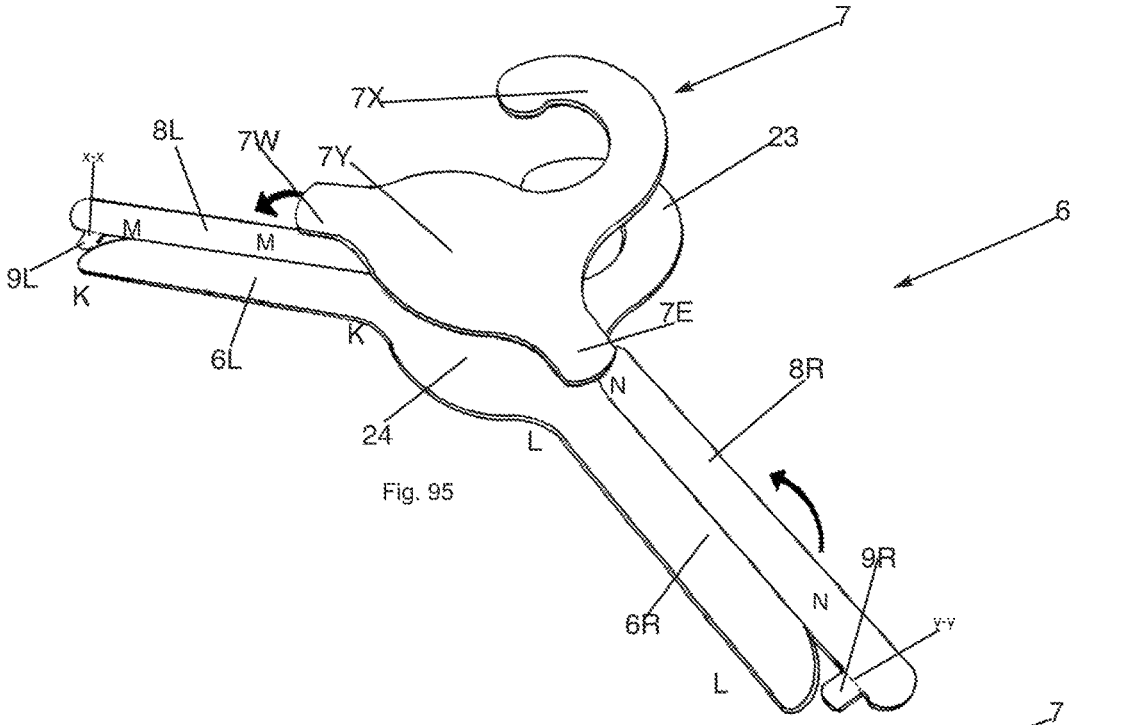
Fig. 95
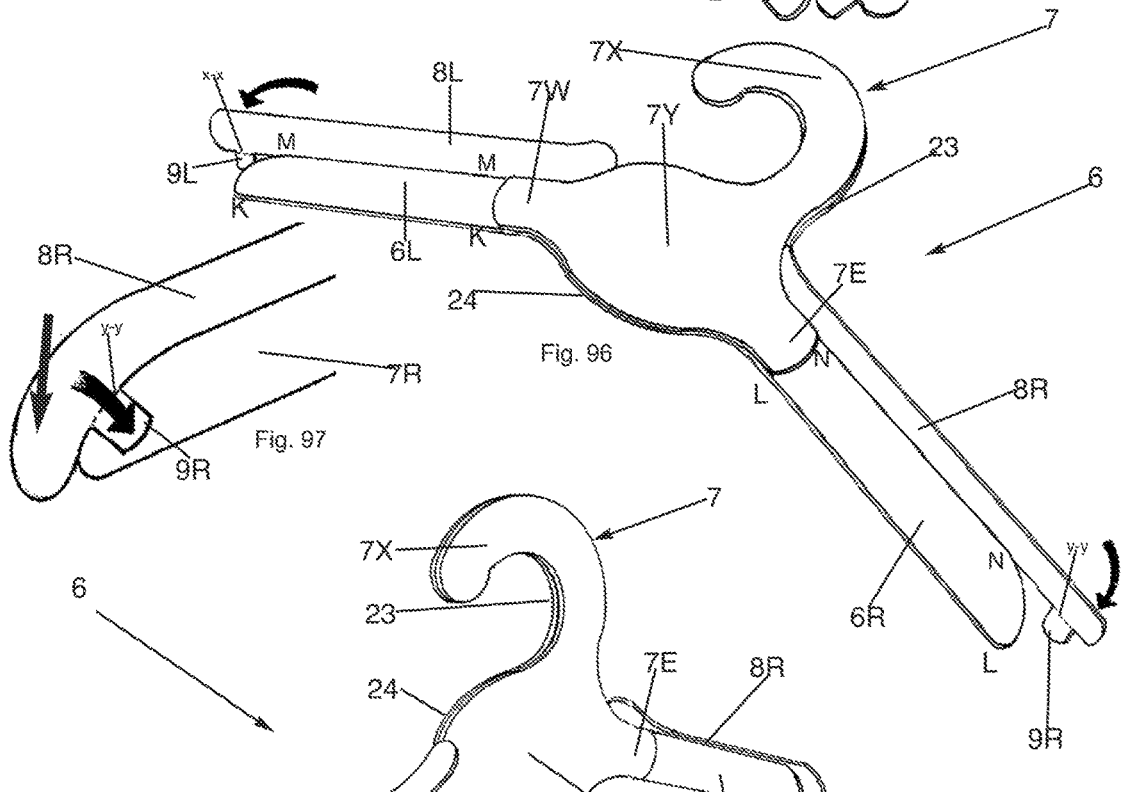
Fig. 96
Fig. 97
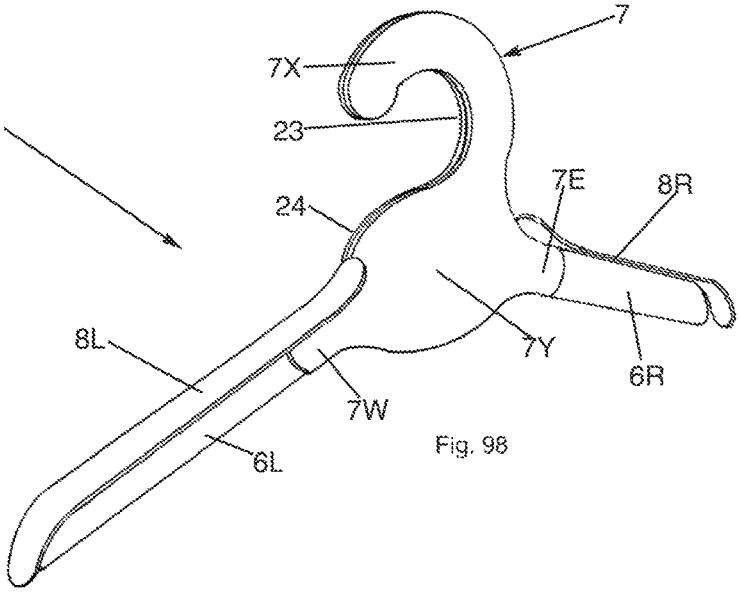
Fig. 98

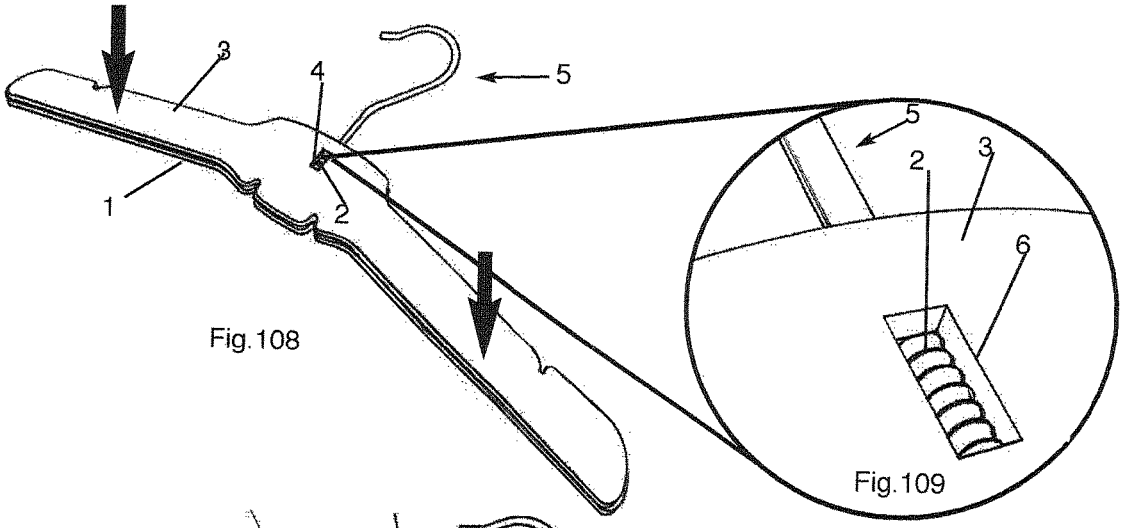
Fig.108
Fig.109
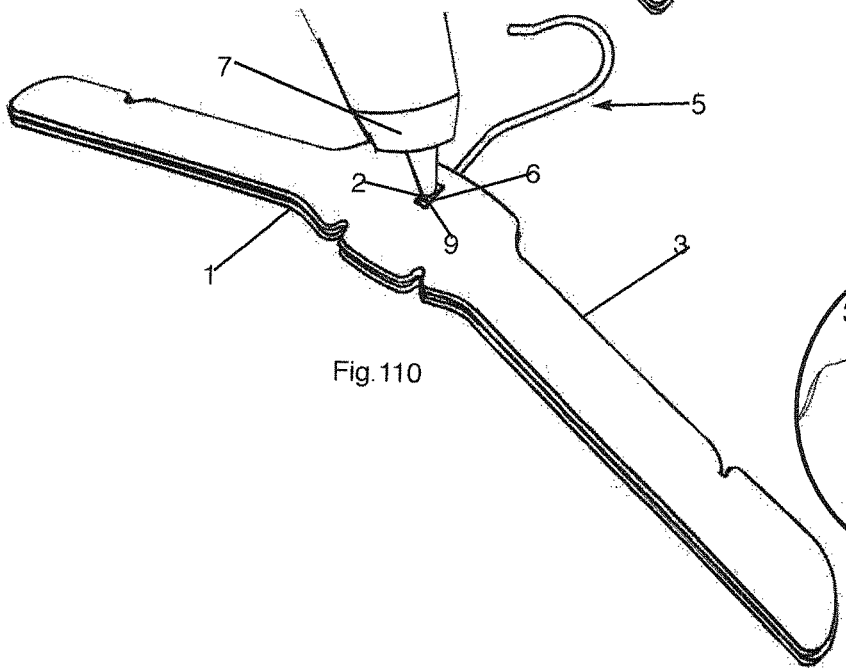
Fig.110
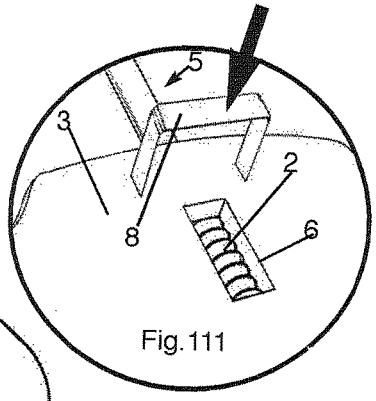
Fig.111
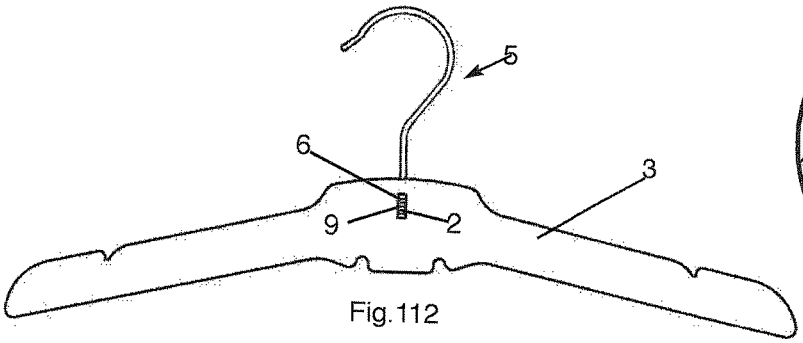
Fig.112
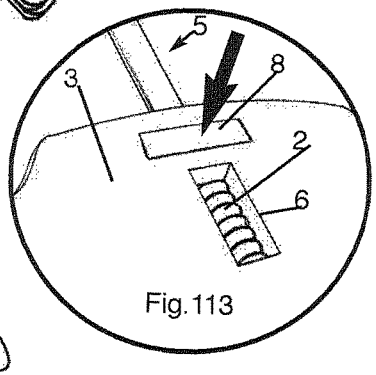
Fig.113

CLOTHES HANGERS

BACKGROUND

The present invention relates to clothes hangers, both planar and moulded, and related accessories, and particularly in the case where methods of adding width to the upper surfaces to substantially planar hangers are exploited, including methods of attaching a metal hook to a planar hanger.

Companies are constantly seeking to encourage people to purchase their goods, and to encourage existing customers to purchase more. They are also constantly looking for interesting ways of presenting their products. Furthermore, companies are constantly looking for new ways to deal with issues raised by concerns such as the welfare of the environment, and therefore there is a constant demand for the kind of display apparatus which will not only provide the best way of showing garments, but which will address those issues which are of increasing concern to the public without neglecting to enhance and promote the products by providing an impression of quality and value.

With clothing, for example, which is being offered for sale in a modern retail environment, a hanger is an important 'point-of-sale' ('POS') tool, which may be provided with features which can show a garment in its best possible aspect, so it needs to be both attractive and functional. The combination of quality and attractiveness with low-cost is almost always part of the requirement of any POS artefact, and the increasingly important necessity to comply with, and be seen to comply with environmental concerns, means that many clothing retailers are seeking to use new, recyclable, and environmentally friendly materials, which means that designs which work with plastic and metal will not be suitable for materials such as paper, pulp, wood or fiberboards of various types, or any material which comes mainly is sheet form.

SUMMARY

The invention is defined by the independent claims below. Dependent claims are directed to optional features and preferred embodiments.

In any of the claimed aspects mentioned below, any one of the constituent elements, particularly those relating to the hanger frame, sleeves, bar, hook (paper or wire-based), moulded or planar elements, may be formed either from sheet-based material, or from pulp, preferably paper).

Moulded or High-End Hanger & Metal Hook-Fixing

This aspect of the invention is primarily defined in claims 1-8.

The present designs have been conceived, therefore, with the aim of creating a durable and strong hanger using materials which although they may not have the inherent strength of, e.g., plastic, or metal, may be more environmentally friendly, and possibly cheaper with the added advantage of being able to be re-cycled within already existing and non-polluting re-cycling schemes. Although the present design might also be created in standard materials, e.g., plastic or metal, the advantage would be that such a design offers an opportunity to create a strong hanger from less material. However, the main purpose of the invention has been to allow the use of more sustainable materials such as, for example, paper or paper-pulp from which an egg-box is made, with a design which allows a less tensile material to assume a strength beyond it's normal capacities.

According to the present invention therefore, embodiments of a contoured clothes hanger have been developed comprising an outer shell which may be made in one or more pieces, the present embodiment being made in three sections, namely, two arms joined at their inner ends by a central neck-piece fitted over the inner ends and bonded to form the shape of a contoured clothes hanger, supported inside by a substantially planar mainframe which may be die-cut from a suitably stiff material, fitted inside the outer shell, and held in position, either by a series of indentures or flutes on the surface of the outer shell, set so as to form a series of piers running the length of, and either side of, each arm of the inner surface of the outer shell, creating a channel into which the mainframe is fitted and bonded, or by one or more stabilisers fitted across the arms of the mainframe and shaped to fit the inner surface of an outer shell with or without the indentures or flutes. The mainframe may incorporate an attached hook, or may have a hook formed as an extension of the mainframe, which is also equipped with an inward-facing horizontal spike at the end of each arm, to which a crossbar may be attached. Using a similar type of design, smaller shoulder-pieces may be made to fit to a substantially planar clothes hanger, to provide a contoured arm. A way of attaching a metal hook using a flange or staple is also developed in this description.

Attachable Sleeves and Extensions for Increasing Width on Planar Hangers

This aspect of the invention is primarily defined in claims 9-12.

The present designs have been conceived, therefore, with the aim of providing a substantially planar hanger, cut from a sheet of material, with a width on the upper surface of the hanger arm, greater than the thickness of the material from which the hanger is cut, creating a hanger which has one or more of the characteristics of one made from plastic or other material. Although such alternative materials, e.g., paper or fibre, may not have the inherent strength of, e.g., plastic, wood or metal, they may, by reason of design, be provided with strength, in addition to being more environmentally friendly, and possibly cheaper with the added advantage of being able to be re-cycled within already existing and non-polluting re-cycling schemes. Although the present designs might also be created in standard materials, e.g., plastic or metal, the advantage would be that such a design offers an opportunity to create a strong hanger from an inherently weaker material. However, a significant purpose of the invention has been to allow the use of more sustainable materials such as, for example, paper with a design which allows a less tensile material to assume a strength beyond it's normal capacities.

According to the present invention therefore, a series of designs have been developed which increase the width the arms of a substantially planar clothes-hanger to provide the upper surface of the arms with a width greater than the thickness of the material from which the hanger is cut.

Three of these are essentially sleeves created from one or more pieces of material, and a fourth consists in adding a layer of material, which may achieved by folding an extending layer over the hanger arm to double the thickness of the arm. In the case of the sleeves, these may be divided into sections which fold into a tubular form, which may be polygonal, rectangular or triangular in section, and which attach to the hanger arm by means of glue, staples, pins or banding of some kind, or by one or more 'locking' features, either formed on or within the sleeve itself, (or attached or inserted into the sleeve). In two of these sleeves, these tabs fold, when the hanger arm is inserted into the sleeve, into the recess between the hanger arm and the opposite inner surface, or surfaces, of the sleeve, and being designed to be of a size which is slightly larger than the width of the recess, thereby compress the hanger arm against an inner wall of the sleeve to lock the said sleeve onto the hanger arm. In a third, designed to fit a hanger with a cross-bar, a tab or tabs extend outwards from one edge of the sleeve, to wrap around the hanger arm and insert into a slot or slots located within the surface of the sleeve which lies on the other side of the hanger arm, to lock the said sleeve firmly in situ.

Three versions have been disclosed in the present invention, as follows: the first is created from a single piece of material divided along its length by a series of creases, to fold into a rectangular-sectioned tubular format which may be held by gluing or stapling. The sleeve may have, cut out from its upper or lower surface, one or more 'tabs' which, when the sleeve is slid onto the hanger arm, are designed to fold inwards and into the recess within the said sleeve, along fold-lines set within the width of one or more of the panels of the sleeve, such that the width of the said tab occupies the whole width of the recess between the surface of the hanger arm and the inner surface of the opposite wall of the sleeve, to push inwards against the hanger arm, which may be located along the back of the sleeve, and against the inside of the front-panel of the sleeve, allowing the arm to be gripped tightly by the sleeve. It will be understood that the tab or tabs may also be attached by other means such as gluing, stapling etc., or where the said tabs are replaced by an additional panel.

The second embodiment, although similar, has been designed to fit around a hanger arm, where said hanger has a cross-bar. Again, this may be a single piece of material divided into sections by a series of creases, and which has, formed within it a separate recess running along the length of the back of the sleeve, which contains the hanger arm. This sleeve is locked in situ by means of one or more tabs extending from an outer edge of an outer panel, which lock the apparatus to the hanger arm by being pushed into a slot or slots, cut into a corresponding surface on the sleeve which, when deployed, lies on the other side of the hanger arm. Alternatively, in this embodiment, the sleeve may also be held in situ by the gluing or stapling of said tabs, or of an additional panel instead of the tabs.

The third embodiment is similar to the first, except that this version, also consisting of a number of sections divided by creases and formed into a tube, has been designed to have a 'tapered' format, increasing in width outwards from the centre of the hanger. Again the sleeve may have one or more locking tabs cut into a panel of the sleeve, but in this embodiment, the locking-tab, (or tabs) is cut into the front panel of the sleeve, which when the sleeve is slid onto the hanger arm, is pushed inwards to push against the said arm, forcing it against the inner wall of the back panel of the sleeve, to hold the sleeve firmly in situ.

The fourth method of increasing the width of a substantially planar hanger, is to create an extension of the arm, either above or below said arm, separated by a fold-line which is set centrally between the two sections of each arm, the sections being roughly symmetrical, so that when folded together and held by gluing, stapling or such, will double the width of the arm.

Provision of Top-Surface, and Information Window on Planar Clothes Hanger Arms

This aspect of the invention is primarily defined in claims 13-18.

With regard to cost, the present designs have created the hangers from more than one part whereby more units may be created from less material. Such designs may utilise less expensive materials by skilful deployment of stronger material to the place where it is necessary, thereby allowing those parts of the hanger which do not require strength to be made from less, and therefore less expensive material, driving down unit costs. If, for example the material selected for a clothes hanger was paper or board of some kind, the material would normally come in sheet form, and the hanger profile would probably be die-cut from the sheet. Although this technique can produce a simple and strong clothes hanger, it leaves such a hanger with a narrow top-surface, which tends to both mark the garment, not allowing clothing to 'fill-out' during display, as a hanger with a wider top-surface would be able to do. The developments disclosed here have been designed to address these questions by creating a wider top-surface by forming a sheet-material into three dimensions rather than the two-dimensional planar hanger.

According to the present inventions therefore, the requirement to provide a hanger with a greater width along the top-surface of the arms, has been addressed, first, by creating a design where the arms are formed by folding a flexible sheet material, e.g., paper or board, into rectangular-sectioned tubes, which, being formed to fit extensions projecting outwards from either side of a central section, are then plugged onto those extensions on the said central section, which may include a hook.

The first of these embodiments consists of arms created from a flat piece of material configured and folded to form a simple four-sided tube, the width of which is limited simply by the size of the 'box' itself.

In the second configuration, the tubes forming the arms have been constructed to allow a top surface to extend outwards a short distance along the length of the arm, supported along its length by the box construction below. Provision has also been made for a design to replace the integral cardboard hook with metal hook. Additionally, windows have been incorporated in both sides of the centre-section allowing an information-tab to be inserted between the panels, which may relate to the size of a garment.

A third embodiment has been created whereby a single profile is formed by folding and fixing a series of substantially parallel planar strips, extending outwards from a central or hook-section, such that a flat top-surface is formed on either 'arm' of the hanger, extending horizontally outwards along the length of the arm, more or less, at a right-angle to the substantially planar profile. This embodiment may be created from one profile including a hook section, or from a profile, which may either, include the hook section, or not include it, a separate hook section being attached to provide greater strength.

Attaching a Standard Ringed Metal Hook to a Planar Clothes Hanger

This aspect of the invention is primarily defined in claims 19-21.

Here is described a method of attaching a standard, ring-shanked metal hook to a substantially planar clothes hanger by compression of the shank between two surfaces which may be glued, pinned, stapled or otherwise held together. Additional security and strength may be added where the hanger is made from two layers, by providing a centrally located aperture at a level in each of the layers corresponding to the position of the shank, in the case, for example, of a hook provided with a 'ringed' shank where a small quantity of resinous material may be inserted into the aperture to harden or coagulate around the said shank, thereby trapping the shank within the upper body of the hanger in the same way as this type of hook is embedded in the body of a plastic hanger, which thereby allows the hanger to function like a wood or with a metal hook, including the ability to be moved at speed along those systems required by cleaning, transport and high-volume storage requirements.

BRIEF DESCRIPTION OF THE DRAWINGS

Embodiments of the present invention will now be described by way of example with reference to the accompanying drawings, in which:

Moulded or High-End Hanger & Metal Hook-Fixing

FIG. 13 shows the central section of a substantially planar hanger in elevation, with an aperture cut into its centre.

FIG. 14 shows how the hook is placed onto the aperture.

FIG. 15 shows how the staple fits around the hook-shank.

FIG. 16 shows how the staple 'legs' splay out on the obverse of the hanger.

FIG. 17 shows, from below, the staple in position prior to being inserted.

FIG. 18 shows the staple in situ with the lags splayed on the obverse of the hanger surface.

FIG. 19 shows the staple in perspective, prior to insertion.

FIG. 20 shows the hook with pommel or ring at the base.

FIG. 21 shows the hanger 'shell' without the indents/flutes, with the mainframe below prior to assembly, and incorporating separate stabilisers.

FIG. 22 shows one stabilizer, and . . . .

FIG. 23 shows the other.

FIG. 24 shows an arm of the mainframe with an indent cut into its upper edge.

FIG. 25 shows how the stabilizer is fitted to the arm.

FIG. 26 shows the completed hanger in elevation.

Attachable Sleeves and Extensions for Increasing Width on Planar Hangers

Figure 34:
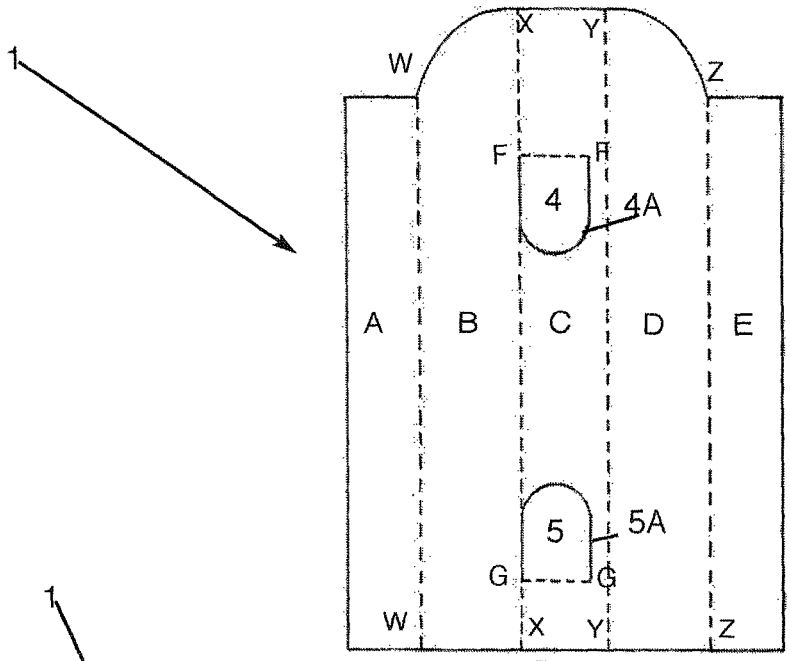

FIG. 34 shows the sleeve with creases and tabs prior to folding.

Figure 35:
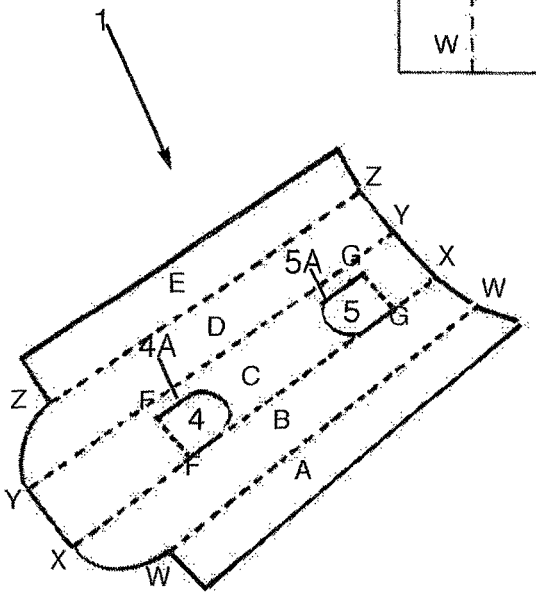

FIG. 35 shows a perspective with the folding beginning.

Figure 36:
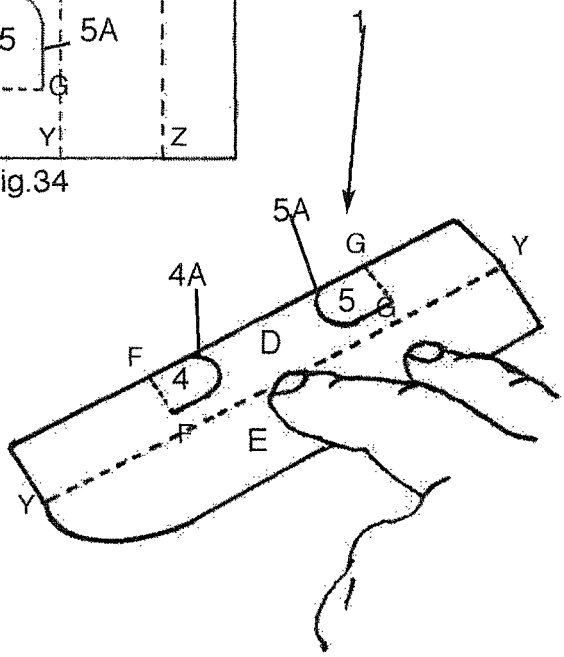

FIG. 36 shows from the outside the way the folding may be completed.

Figure 37:
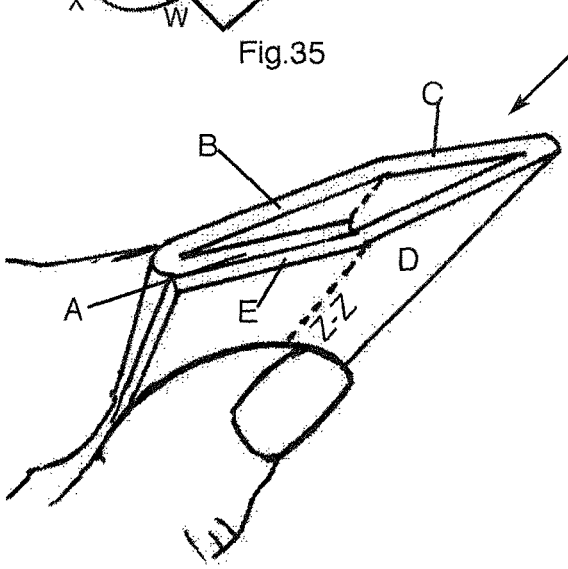

FIG. 37 shows how the sections are folded and glued/pinned/stapled/attached.

Figure 38:
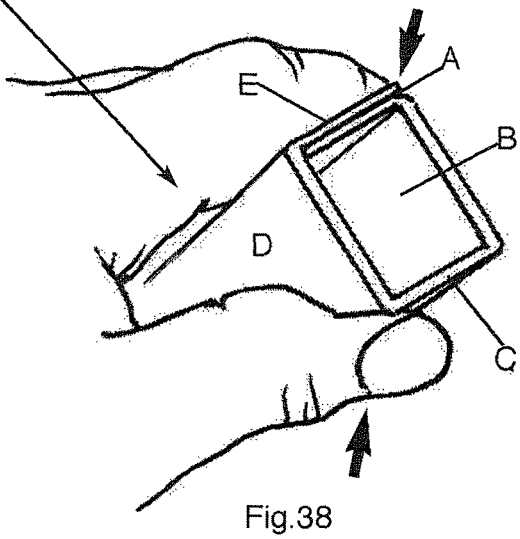

FIG. 38 shows how the apparatus may be deployed prior to attachment to the hanger arm.

Figure 39:
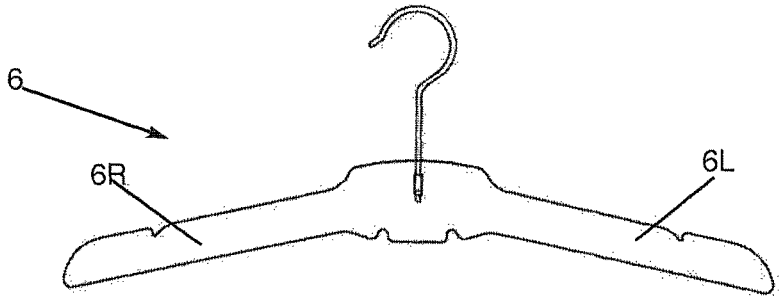

FIG. 39 shows the planar clothes hanger.

Figure 40:
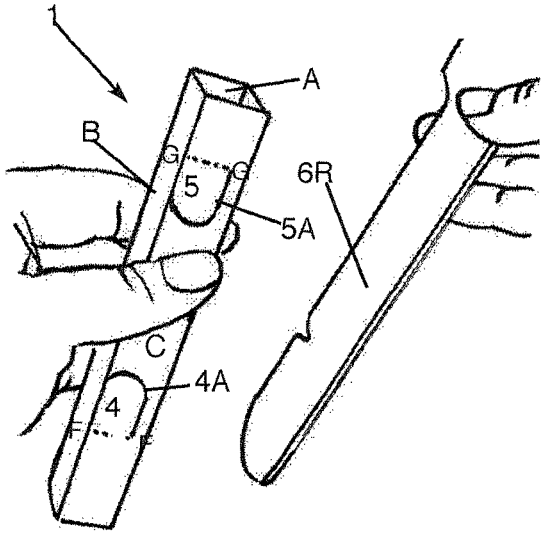

FIG. 40 shows the sleeve and hanger-arm prior to attaching.

Figure 41:
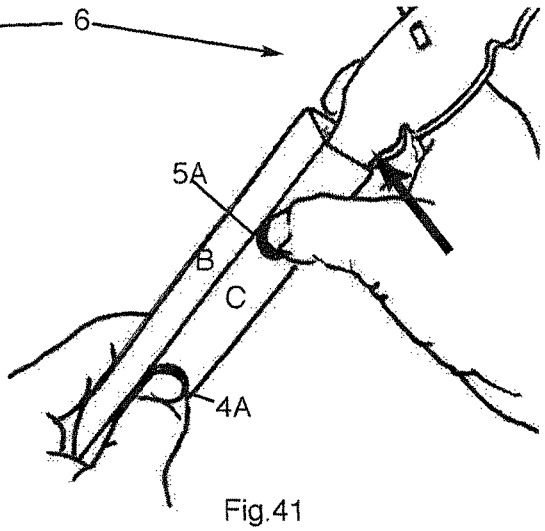

FIG. 41 shows the attaching of the sleeve to the hanger arm, and how the locking-tabs are deployed to hold the sleeve in situ.

Figure 42:
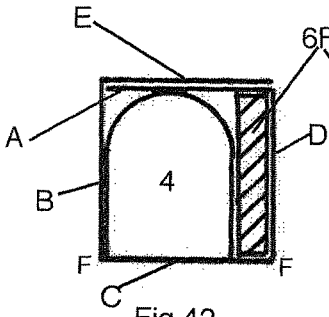

FIG. 42 shows in section, viewed from inside and along the length of the sleeve, how the locking-tab fits into the recess in the sleeve to hold the hanger arm against the back of the sleeve.

Figure 43:
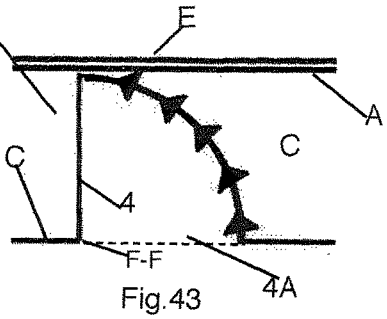

FIG. 43 shows the movement of the tab through the front panel.

Figure 44:
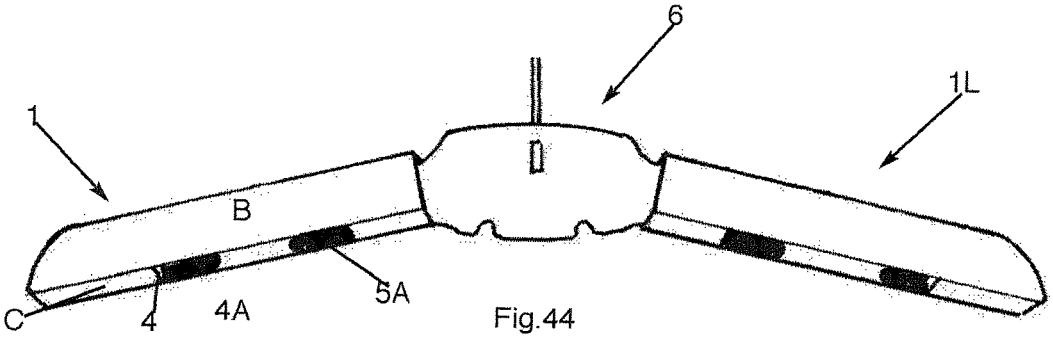

FIG. 44 shows the complete hanger with both sleeves fitted.

Figure 45:
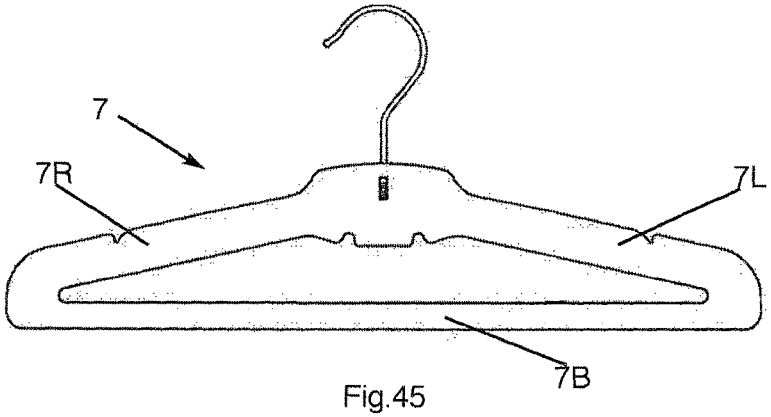

FIG. 45 shows another planar hanger with cross-bar.

Figure 46:
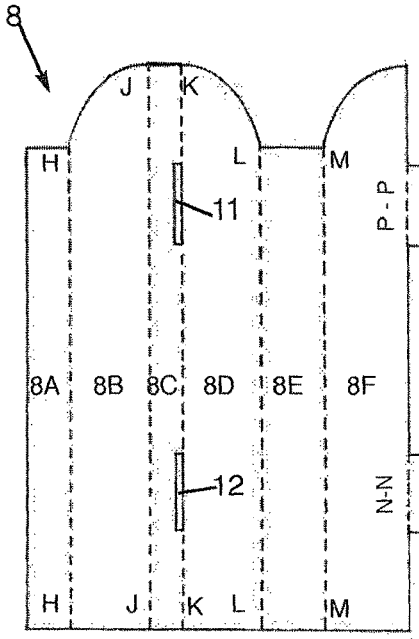

FIG. 46 shows the second version of the sleeve with creases, tabs and slots.

Figure 47:
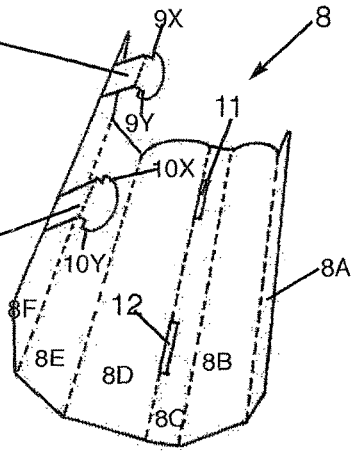

FIG. 47 shows how the folding begins.

Figure 48:
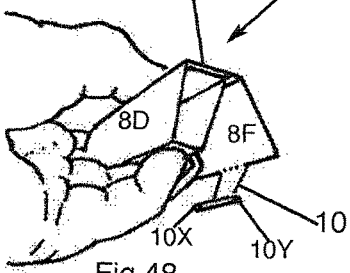

FIG. 48 shows a further stage in the folding.

Figure 49:
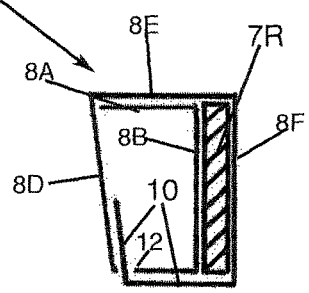

FIG. 49 shows the section with the separate recess accommodating the hanger-arm.

Figure 50:
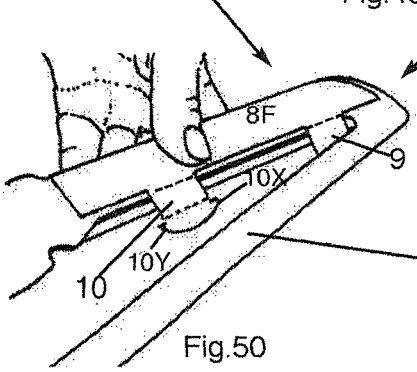

FIG. 50 shows the fitting of the sleeve from the back of the hanger, prior to insertion of the tabs into the slots.

Figure 51:
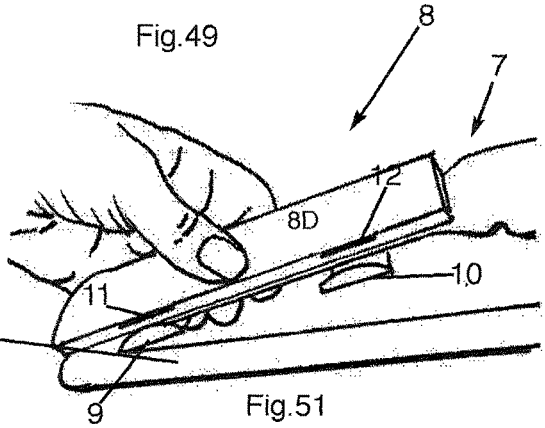

FIG. 51 shows the same, from the front.

Figure 52:
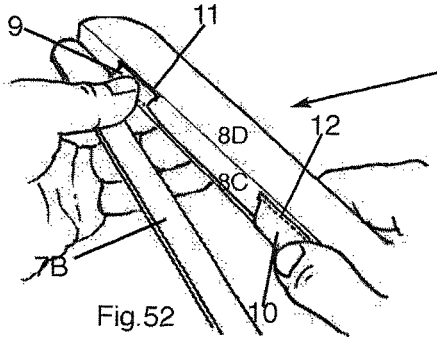

FIG. 52 shows the tabs being pushed into the slots.

Figure 53:
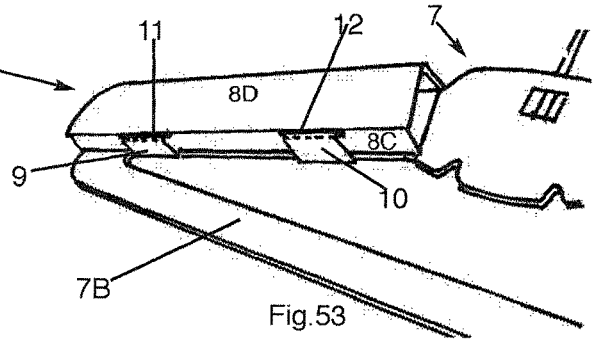

FIG. 53 shows the locking tabs in situ.

Figure 54:
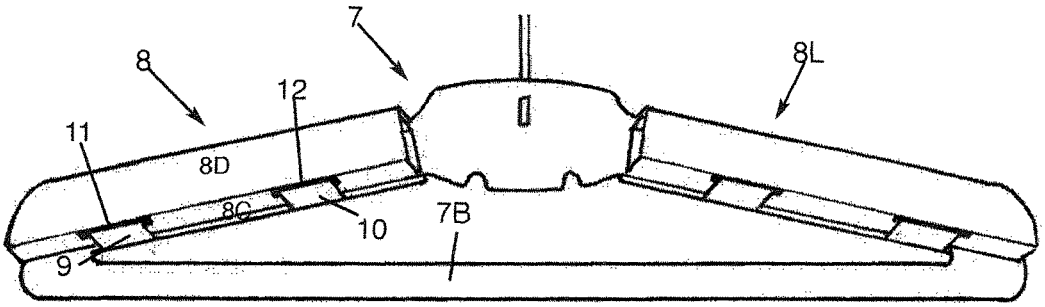

FIG. 54 shows the front-view of the completed hanger with the sleeves in situ.

Figure 55:
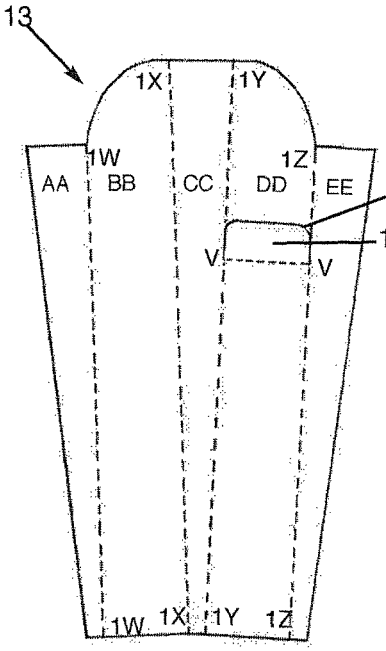

FIG. 55 shows the third embodiment with creases and locking tab, prior to folding.

Figure 56:
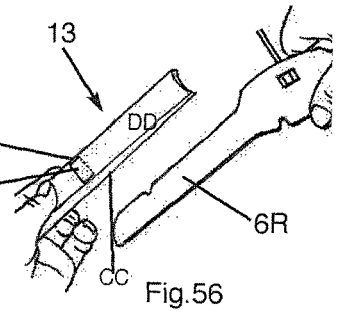

FIG. 56 shows the fully formed sleeve and hanger-arm prior to attachment.

Figure 57:
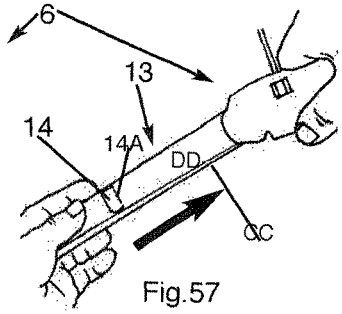

FIG. 57 shows how the sleeve is slid onto the hanger arm.

Figure 58:
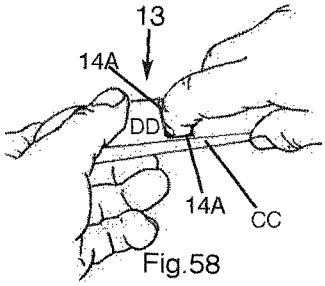

FIG. 58 shows how the locking tab is deployed by being pushed inwards against the hanger arm to lock it in situ.

Figure 59:
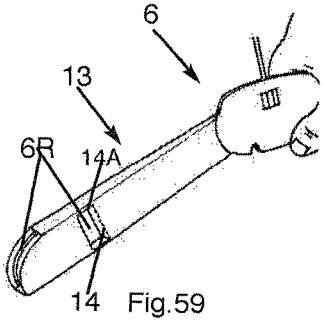

FIG. 59 shows the arm in situ with the locking tab fully deployed.

Figure 60:
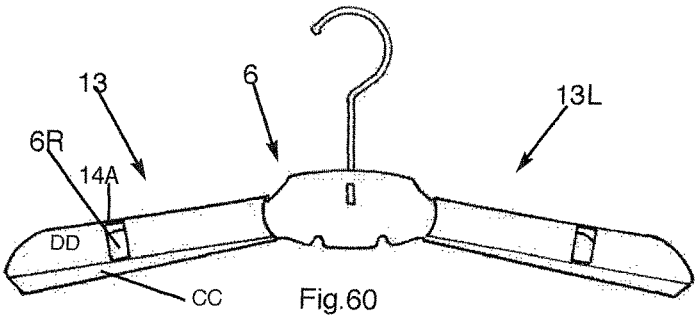

FIG. 60 shows the completed hanger with both sleeves fitted.

Figure 61:
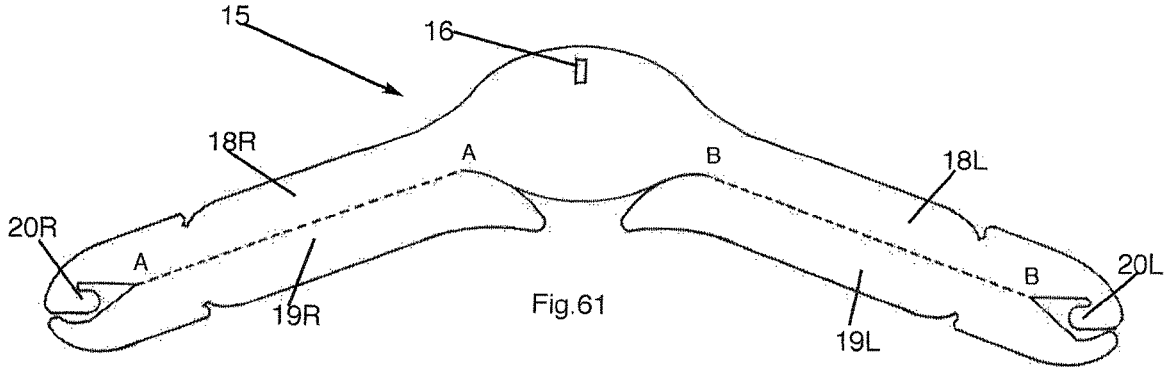

FIG. 61 shows a substantially planar hanger with extensions set below each arm.

Figure 62:
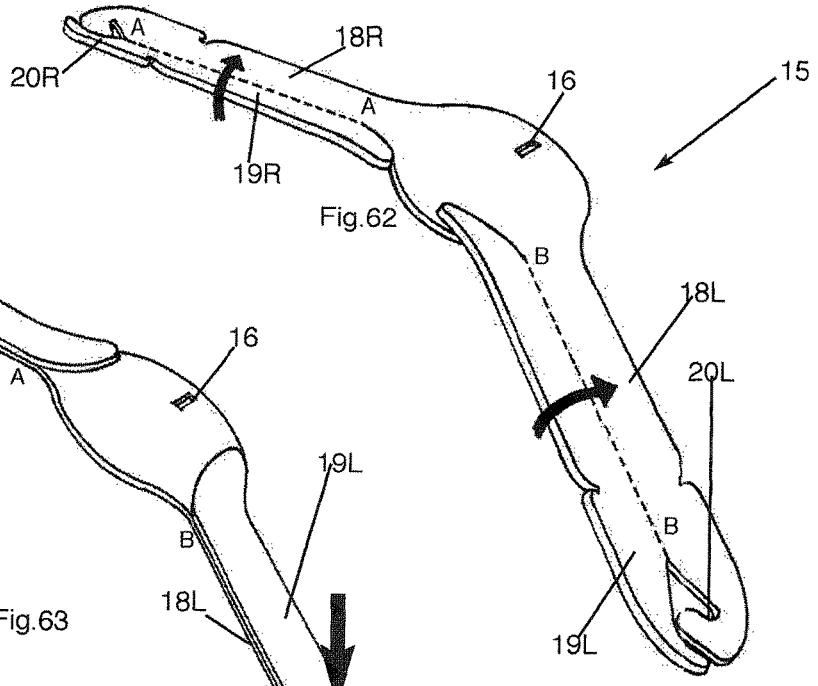

FIG. 62 shows these lower sections during the initial phase of their being folded upwards against the upper part of the arm.

Figure 63:
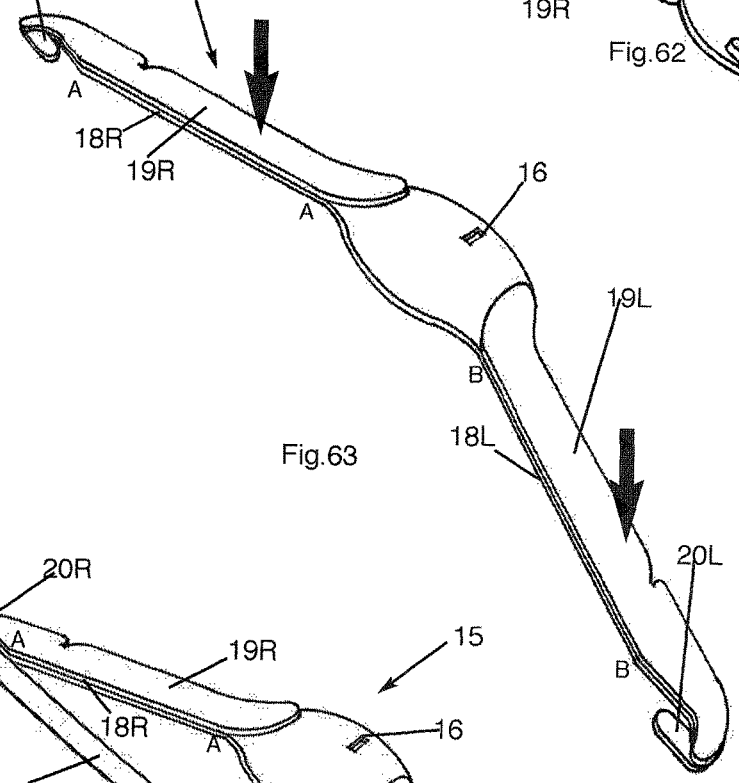

FIG. 63 shows the folding completed.

Figure 64:
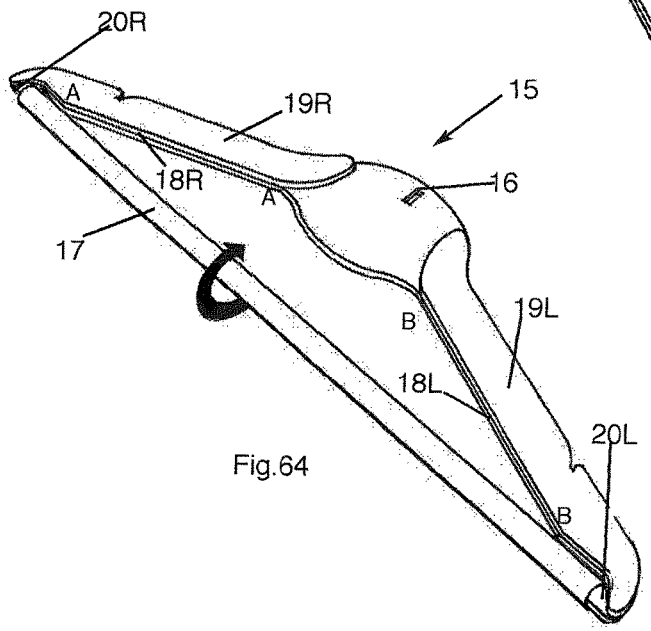
Figure 65:
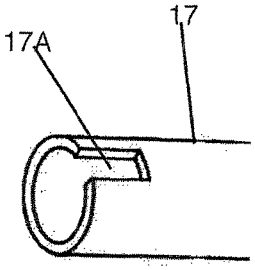

FIGS. 64&65 show how a tubular crossbar may be attached to the hanger by means of an indent cut into the end of the tube/crossbar.

Provision of Top-Surface, and Information Window on Planar Clothes Hanger Arms

Figure 66:
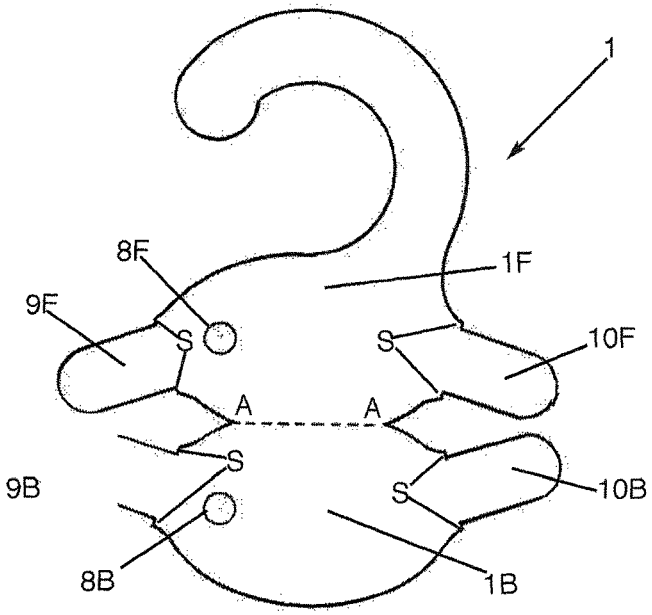

FIG. 66 shows a die-cut planar, centre-section and hook in two sections separated by a fold line prior to folding.

Figure 67:
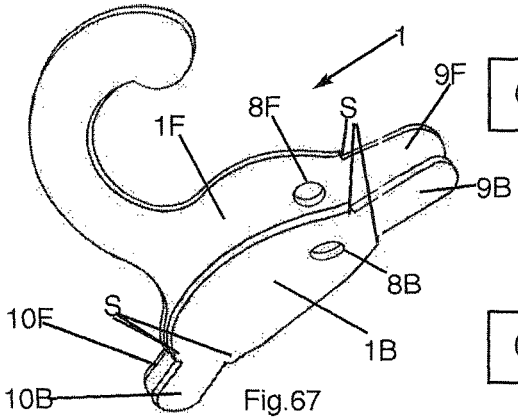

FIG. 67 shows the centre-section with the lower section folding upwards to meet the obverse side of the upper or hook section.

Figure 68:
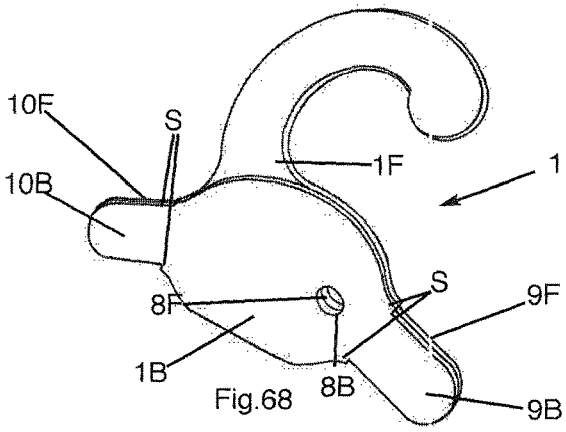

FIG. 68 shows the obverse side where the lower section is folded flat against the back of the upper section.

Figure 69:
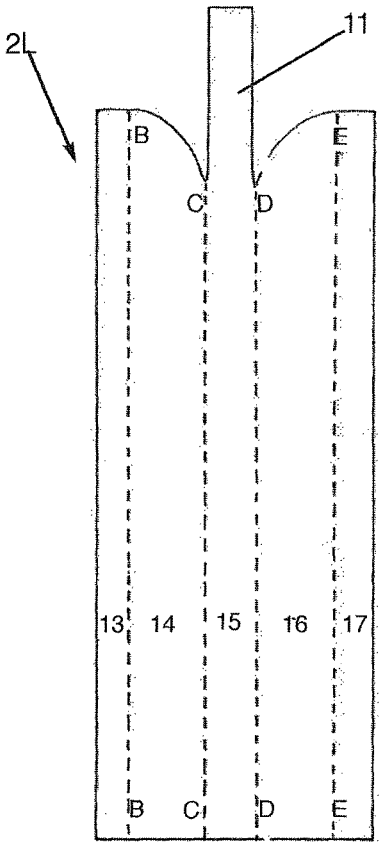

FIG. 69 shows the flat profile of one arm prior to folding.

Figure 70:
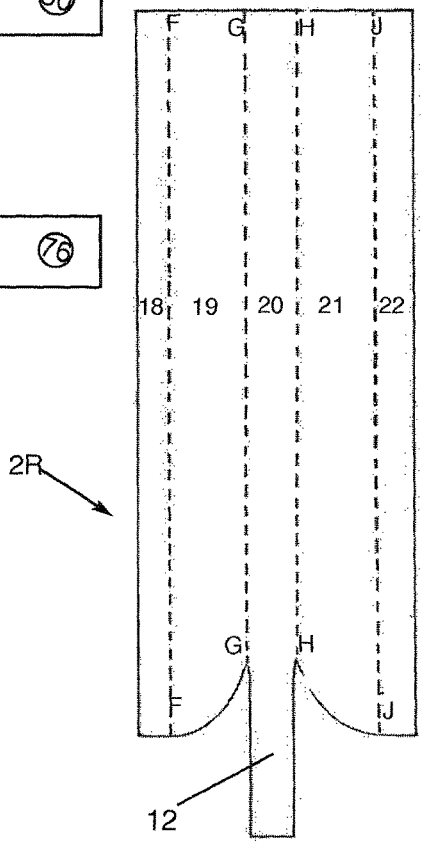

FIG. 70 shows the other arm.

Figure 71:
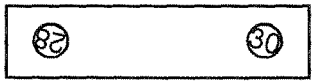
Figure 72:
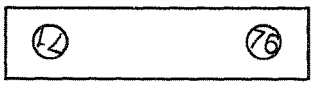

FIGS. 71&72 show both sides of a tab bearing information which may relate to garment size.

Figure 73:
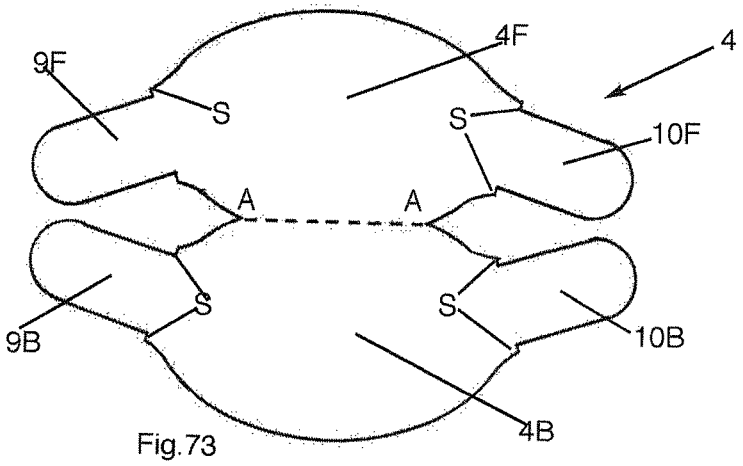
Figure 74:
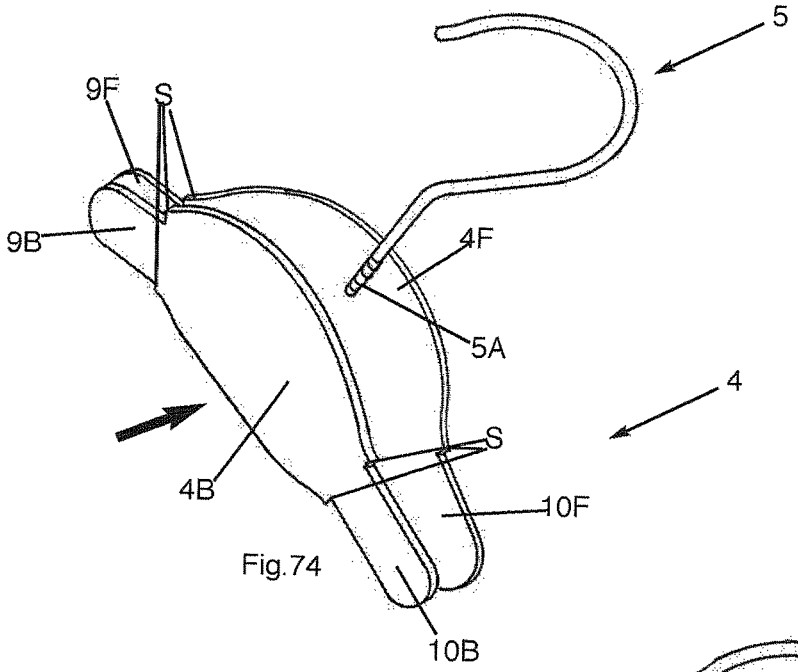
Figure 75:
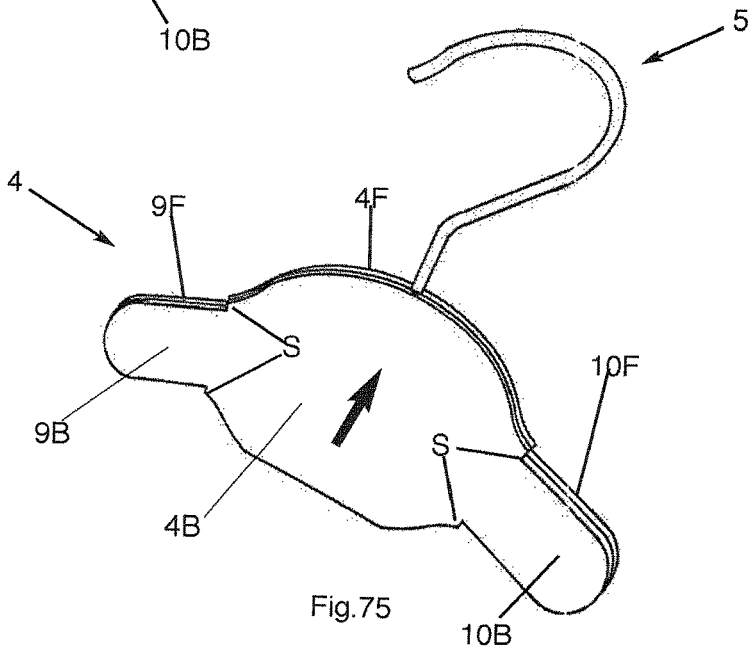

FIGS. 73-75 show an alternative hook section where a metal or wire hook may be inserted between to two centre-section surfaces.

FIGS. 76-80 are schematic drawings showing how the arm profiles are folded into rectangular tube forms.

Figure 80:
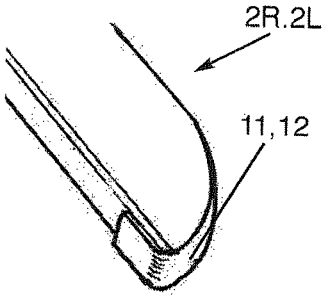
Figure 80A:
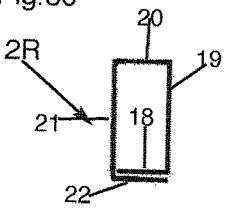

FIG. 80A shows a cross-section through the folded and fixed arm looking from the outer end.

Figure 81:
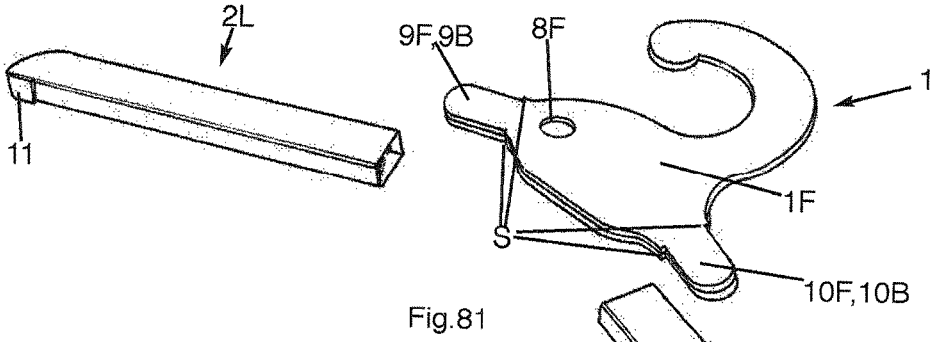

FIG. 81 shows the three fully-formed hanger sections, prior to assembly.

Figure 82:
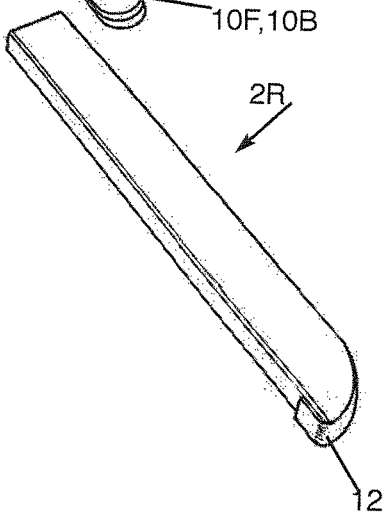
Figure 82:
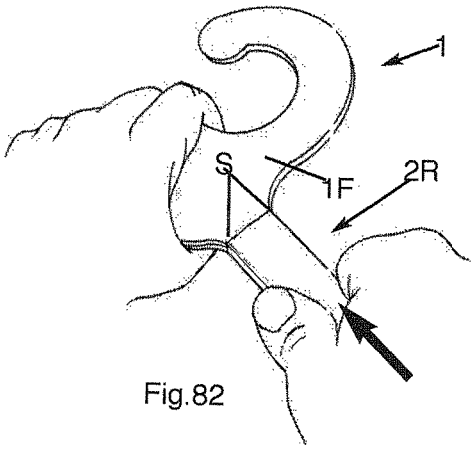

FIG. 82 shows the arm being 'plugged' onto the right extension of the hook section.

Figure 83:
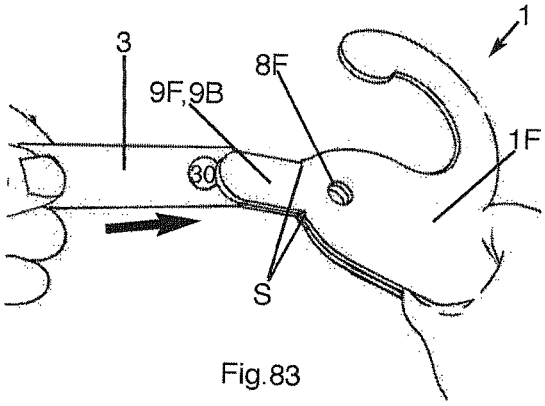
Figure 84:
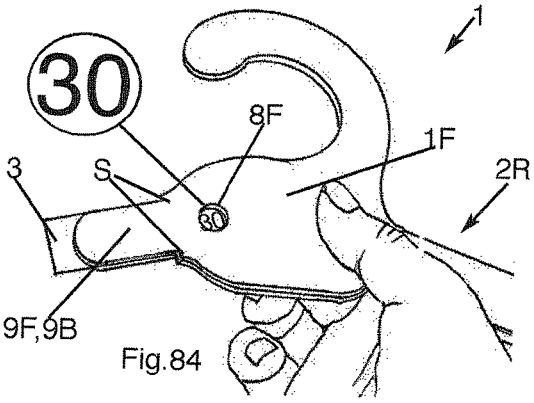
Figure 85:
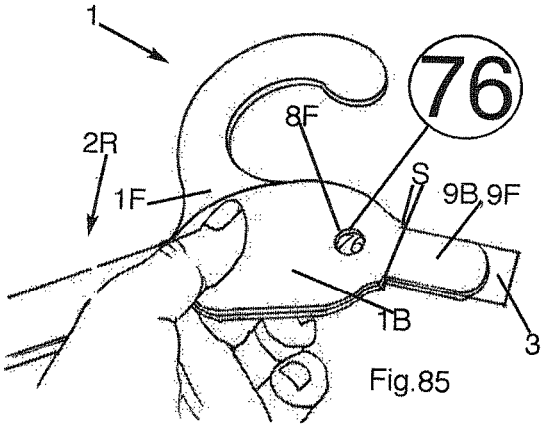

FIGS. 83-85 show how the tab slides between the two centre-sections so that the information thereon, is exposed through the windows located on either side of the hook section.

Figure 86:
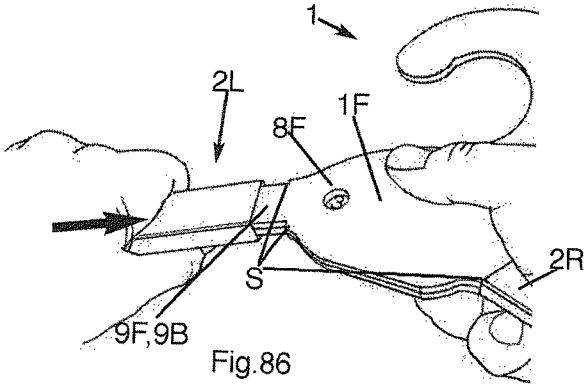

FIG. 86 shows the assembly being completed by the attaching of the opposite arm to the centre section.

Figure 87:
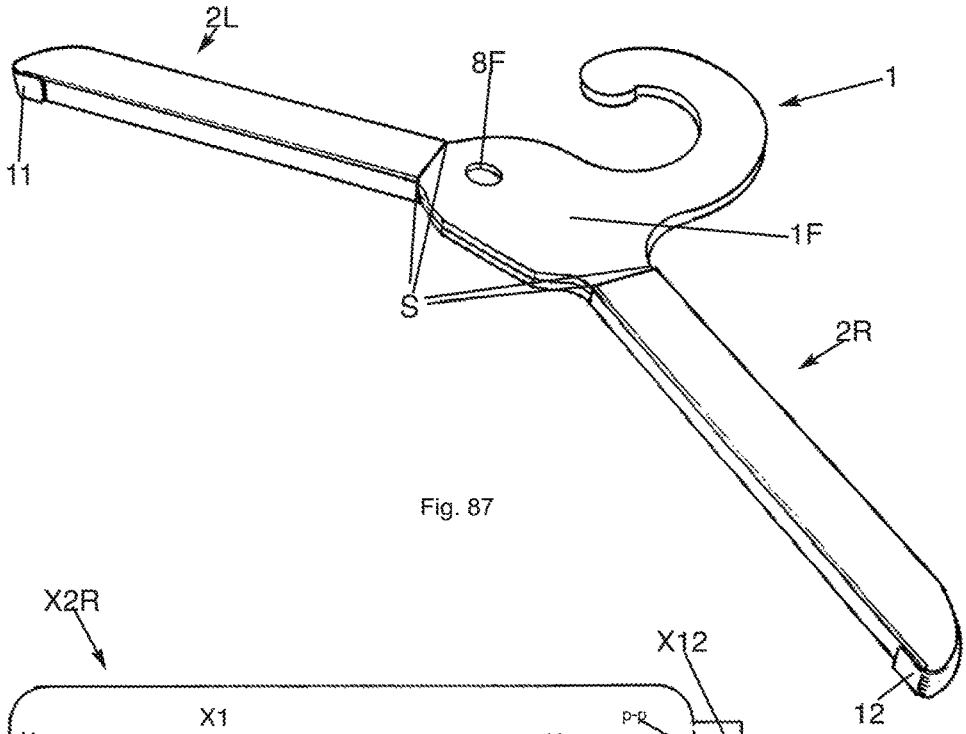

FIG. 87 shows the assembled hanger.

FIGS. 88-91 show an alternate construction for the tubes which form the hanger arms.

Figure 88:
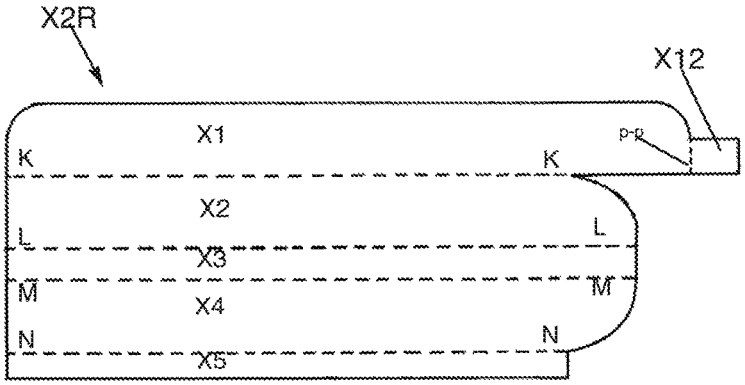

FIG. 88 is the profile of the alternative arm prior to folding.

Figure 89:
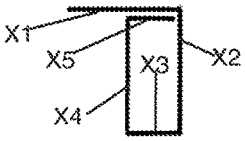

FIG. 89 shows the cross-section of the folded arm looking from the outer end of the arm.

Figure 90:
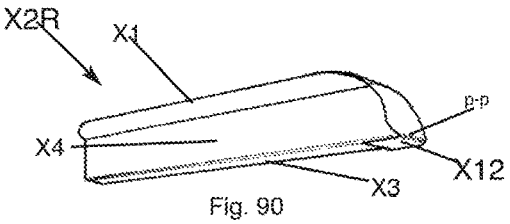

FIG. 90 shows the completed arm in perspective.

Figure 91:
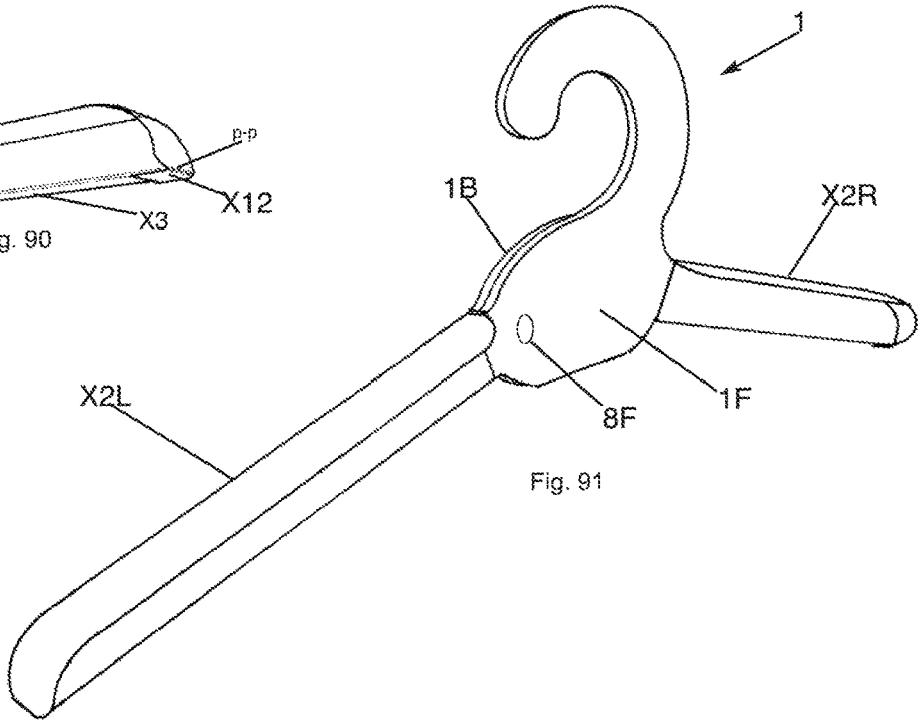

FIG. 91 shows the fully constructed hanger with the alternate arms.

Figure 92:
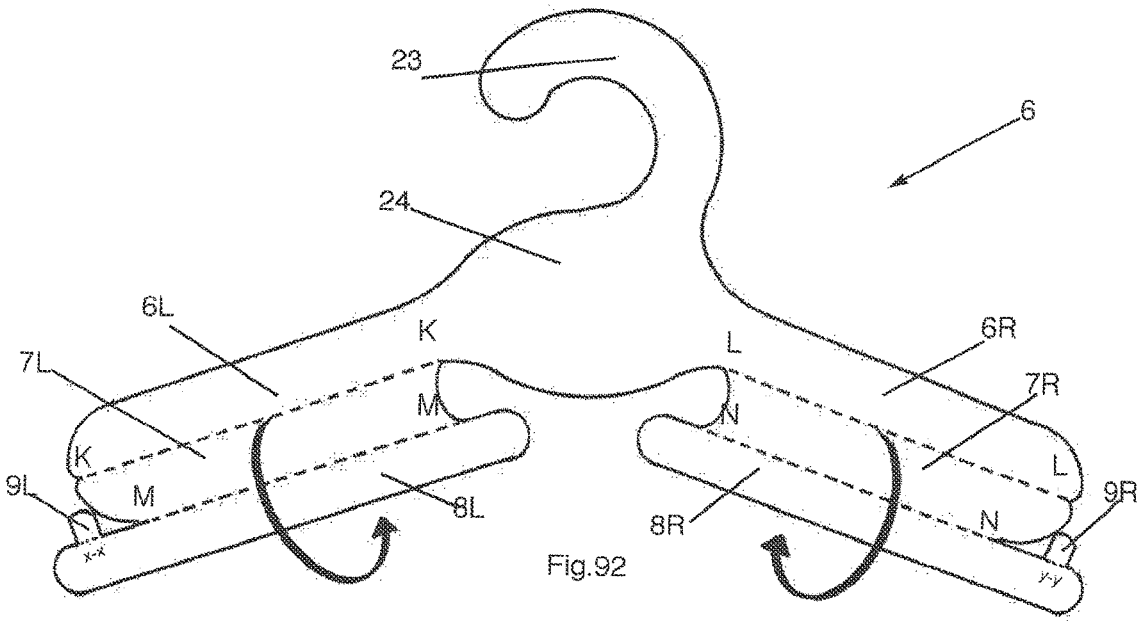

FIG. 92 shows the profile of hanger prior to folding and fixing, with arrows indicating the folding of the sections backwards along the underside of the hanger profile.

Figure 93:
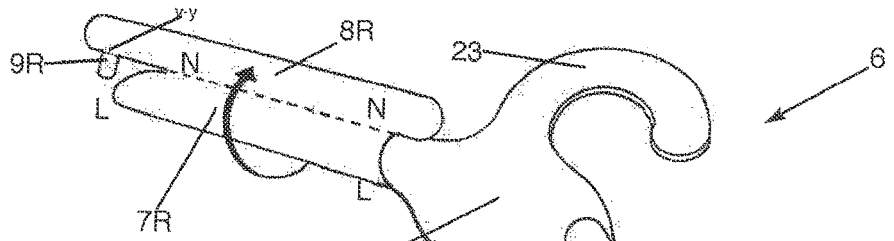

FIG. 93 shows the obverse where the lower sections fold upwards and onto the back of the profile.

Figure 94:
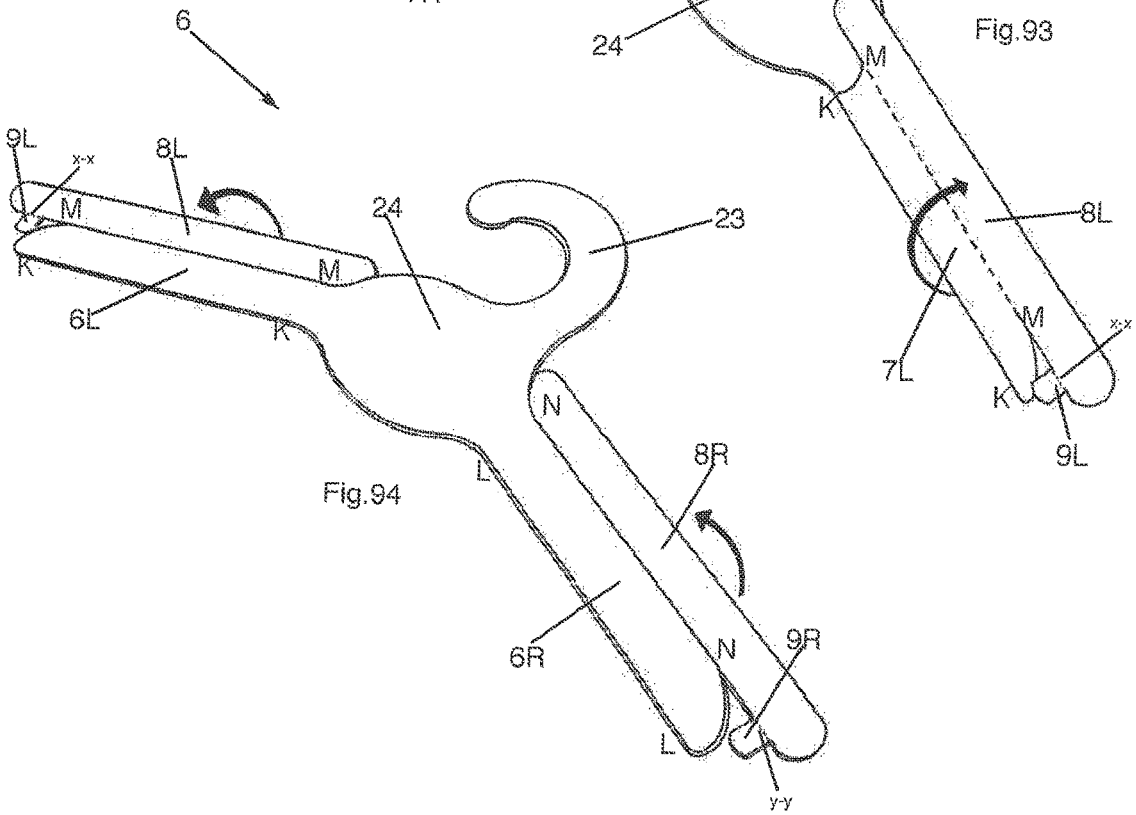

FIG. 94 shows the front area with the folded sections which will form the top-surfaces appearing over the top of the arms.

FIG. 95 shows how an added centre or hook form may be added to central section to provide greater strength.

FIG. 96 shows how the top-surfaces are folded downwards to form a right-angle with the hanger arms.

FIG. 97 shows how the fixing tabs fold downwards at the back of the ends of the hanger arms and are fixed in situ to form a downwards-curve at the tips of the hanger arms.

FIG. 98 shows the fully formed hanger.

Figure 1:
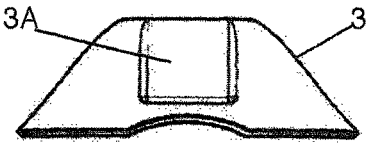
FIG. 1 shows the neckpiece of the outer shell of the hanger.
Figure 7:
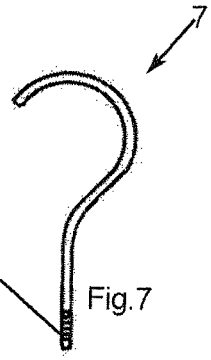
FIG. 7 shows a standard metal hook.

FIGS. 99-102 show an alternative information-tab insertion feature applied to the first embodiment shown in FIG. 1).

Figure 99:
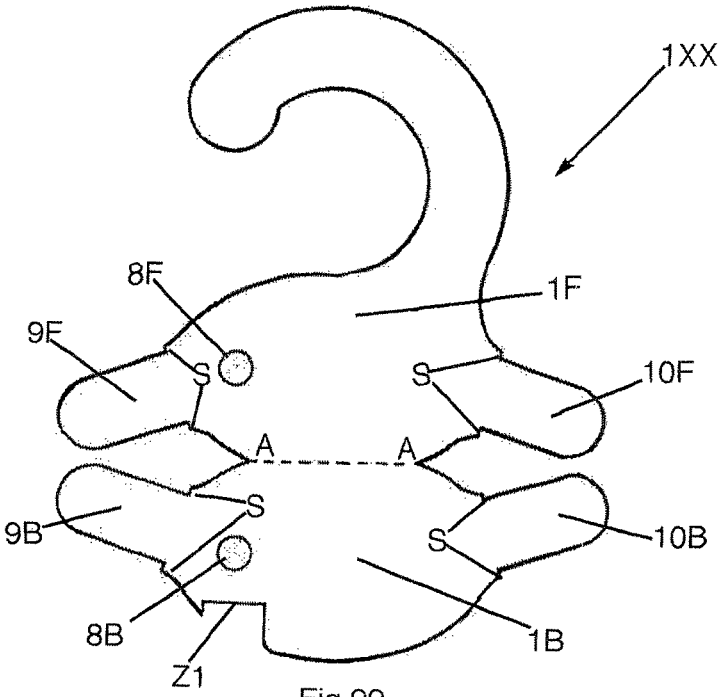

FIG. 99 shows a die-cut planar, centre-section and hook in two sections separated by a fold line prior to folding with a section of the lower panel removed to for an information-tab slot when folded together.

Figure 100:
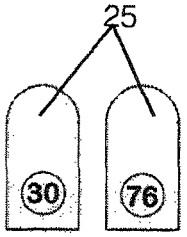

FIG. 100 shows two sides of an information-tab.

Figure 101:
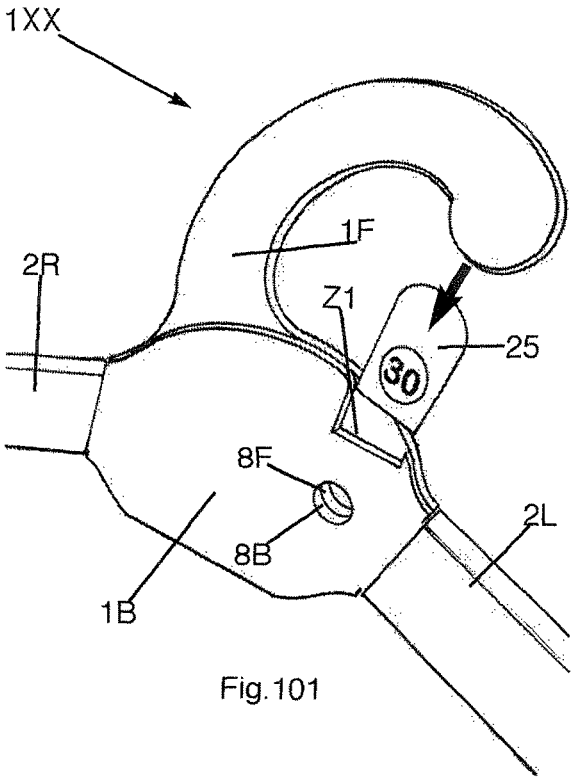

FIG. 101 shows the completed hanger where the information-tab is positioned to slide into the access-slot'

Figure 102:
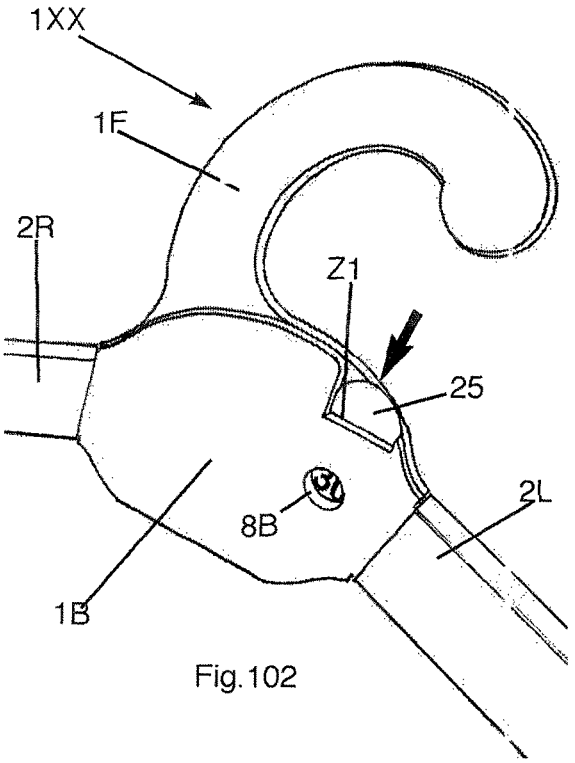

FIG. 102 shows the information-tab in situ where the information is visible through the windows on the central section.

Attaching a Standard Ringed Metal Hook to a Planar Clothes Hanger

Figure 103:
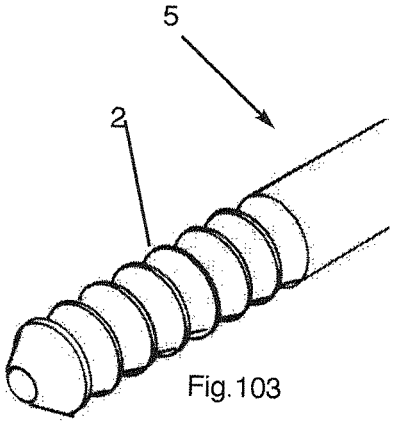

FIG. 103 shows the 'ringed' shank of a standard type of metal hook used widely in most hangers.

Figure 104:
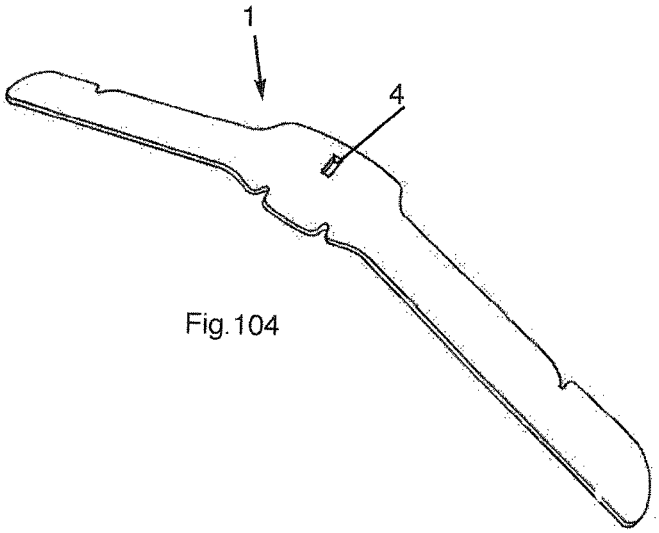

FIG. 104 shows one layer of the hanger profile in perspective.

Figure 105:
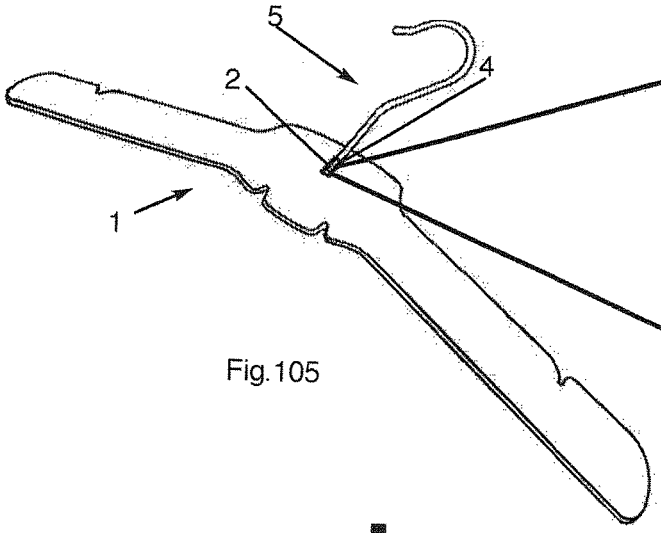
Figure 106:
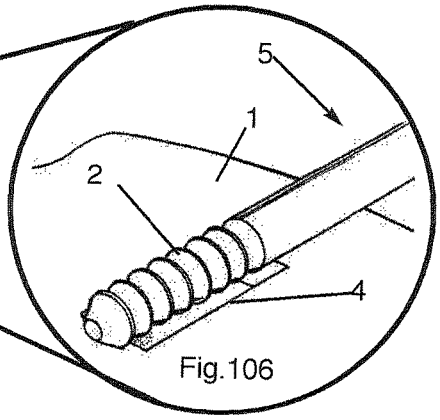

FIGS. 105-106 show how the hook is positioned at the aperture on the first layer of the hanger.

Figure 107:
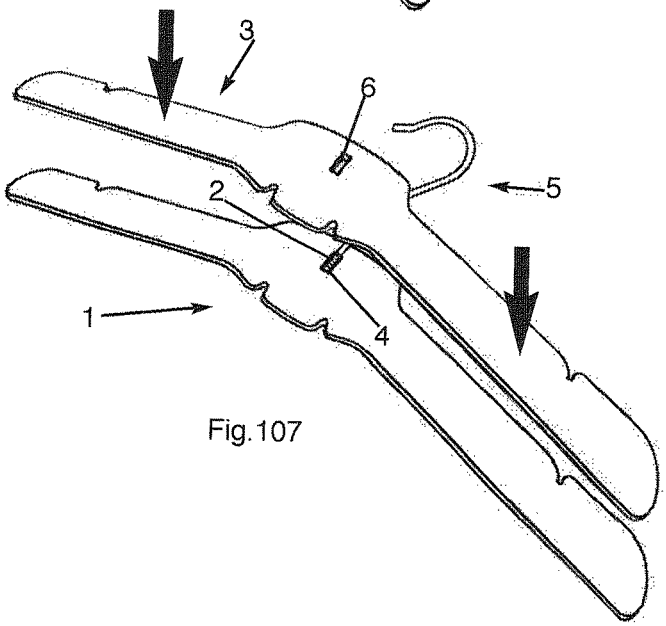

FIG. 107 shows the shank in position, between the two layers. Prior to gluing/fixing.

FIGS. 108-109 show how the shank appears between the two layers.

FIG. 110 shows a resin or glue-injecting tool injecting material into the aperture where the shank is located.

Figure 11:
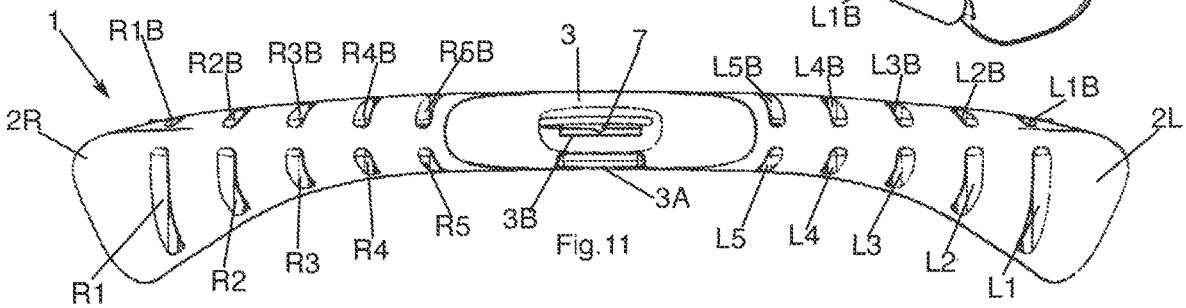
FIG. 11 is a view from above of the fully assembled hanger.

FIG. 11 shows how a staple would be positioned prior to being forced through both layers of the conjoined hanger profiles.

FIG. 112 shows the staple in situ just above the aperture.

FIG. 113 shows the completed hanger in elevation.

DETAILED DESCRIPTION

Moulded or High-End Hanger & Metal Hook-Fixing

Figure 2:
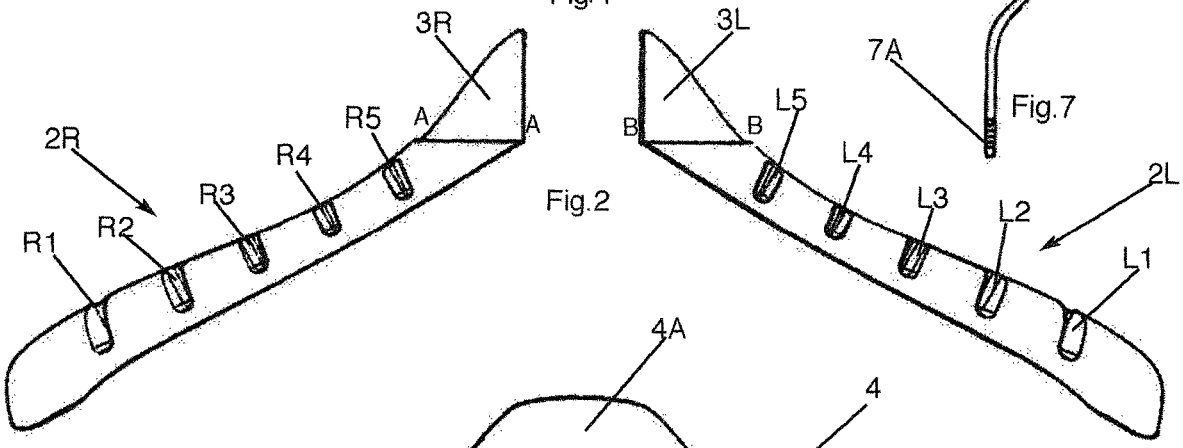
FIG. 2 shows the two shoulder-shells.

According to FIGS. 1-5, FIG. 1 shows the centre or neck-piece 3 with a central indent 3A which features as an area in which to place a label, logo or other information. FIG. 2 shows both arms or shoulders 2R,2L in front elevation showing the series of indents R1-R5, and R1B-R5B on the shoulder 2R, and the indents L1-L5 and L1B-L5B on the shoulder 2L. The top or inner sections 3R,3L are each separated from the outer sections 2R,2L by the ledges A-A, B-B which circumscribe at the top-end, the outer surface of the shoulders 2R,2L above which the upper sections 3R,3L are recessed inwards slightly to allow the neck-piece 3 to fit flush to the shoulder sections 2R,2L when the shoulders 2R,2L are joined within the neck-section 3.

Figure 3:
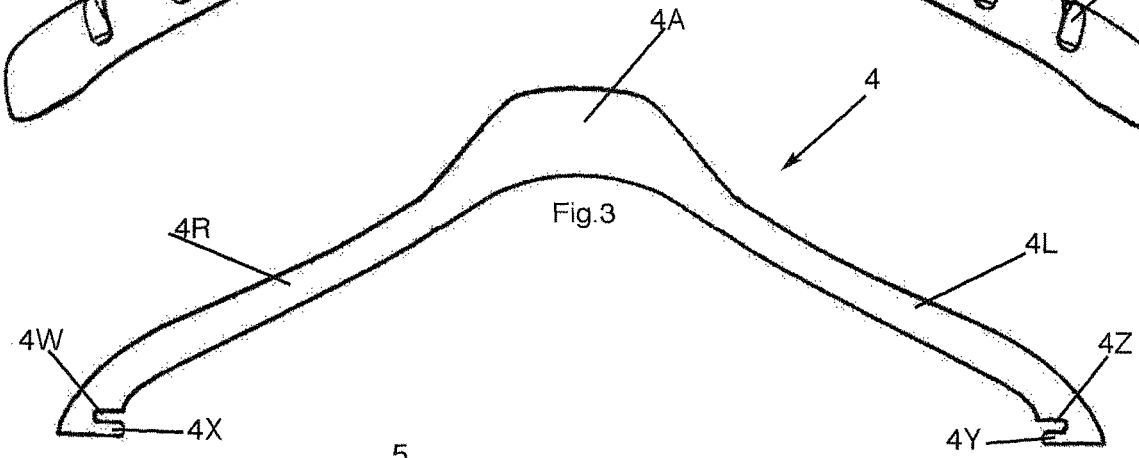
FIG. 3 shows the planar mainframe
Figure 4:
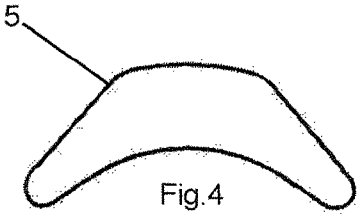
FIG. 4 shows the 'sandwich' section which traps a separate hook.
Figure 5:
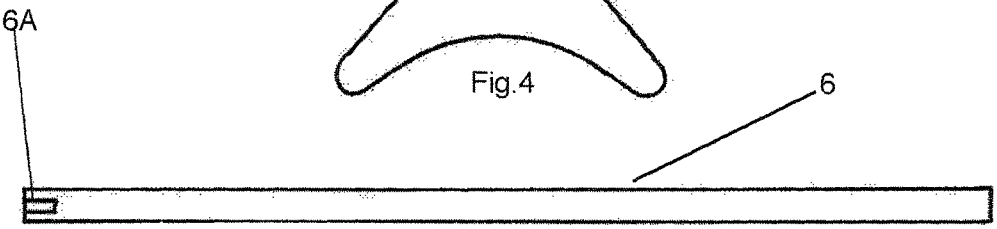
FIG. 5 shows a cylindrical crossbar.

FIG. 3 shows the substantially planar mainframe 4, a single element comprising two arms 4R,4L extending outwards from a central panel 4A. Located at the lower outer ends of the arm 4R,4L are spikes 4X,4Y set on either side of the arms 4R,4L and extending inwards, horizontally a short distance. These are formed by creating two horizontal indents 4W,4Z on the inner surface of the outer ends of each arm 4R,4L.

The spikes 4X,4L are of a size which allows the crossbar 6 to be attached securely. In this embodiment the crossbar 6 consists of a tube of a suitable length and diameter, with a small aperture or slot 6A cut into one end of the tube or crossbar 6 along its length and extending to the end of the tube 6. The crossbar 6 is attached by sliding the end of the crossbar 6 which has no indent onto the spike 4Y, and then sliding the other end of the crossbar 6 upwards onto the spike 4X through the slot 6A, and turning the crossbar 6 through approximately 180 degrees to lock in situ.

In the present embodiment, a standard hook 7 may be set centrally and vertically into the mid-section 4A of the mainframe 4, where another smaller section 5 made, perhaps, from the same material (FIG. 4) cut to correspond to the profile of the said central section 4A of the mainframe 4, may be fixed by being glued, or stapled (or both) under pressure to sandwich the said hook 7 securely in situ.

Figure 6:
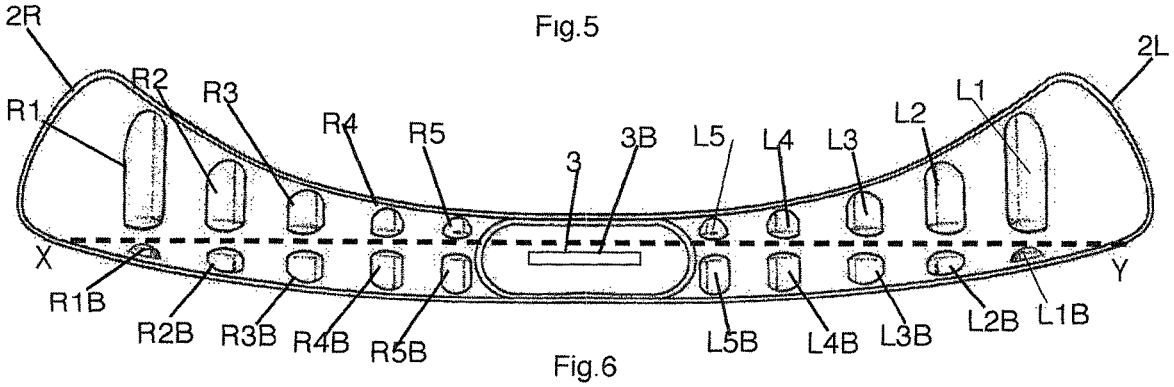
FIG. 6 shows a view from below of the assembled outer shell showing how the flutes on the outside, form piers on the underside to create a straight channel across the width of the hanger.

FIG. 6 shows a view from below of the underside of the assembled outer shell 3,2R,2L where indents R1-R5, and R1B-R5B on the shoulder 2R, and the indents L1-L5 and L1B-L5B on the shoulder 2L now form a cameo aspect to function as a series of 'piers' R1-R5, and R1B-R5B on the shoulder 2R, and L1-L5 and L1B-LS5B on the shoulder 2L, between which, therefore, a straight channel X-Y is formed across the entire width of the underside of the outer shell 3,2R,2L of the hanger.

Figure 8:
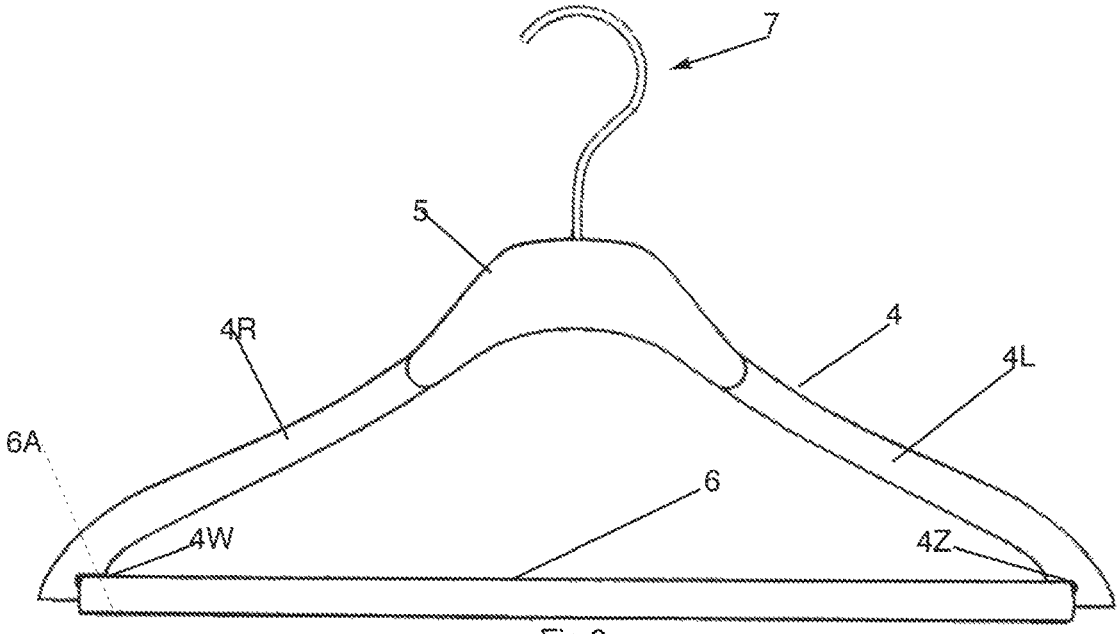
FIG. 8 shows the assembled mainframe, with the hook and crossbar attached.

In FIG. 8 the completed mainframe 4 is shown in elevation with the hook 7 in situ sandwiched between the centre-section 4A and the front panel 5, and with the crossbar 6 also attached. It will be appreciated that the securing panel 5 may be located on either side of the mainframe 4 with the hook 7 set between the panel 5 and the centre section 4A of the mainframe 4.

Figure 9:
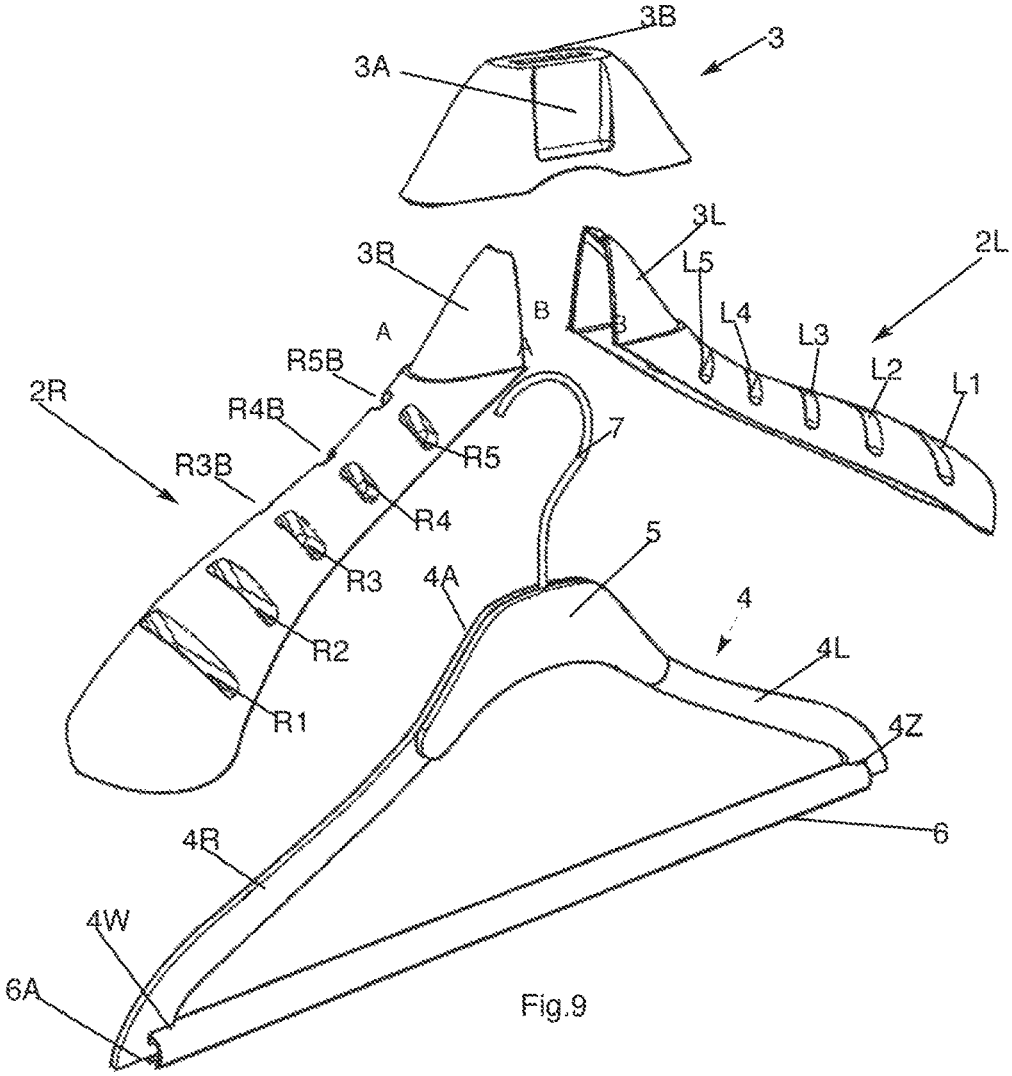
FIG. 9 shows, in perspective, the main separate elements prior to full assembly.
Figure 10:
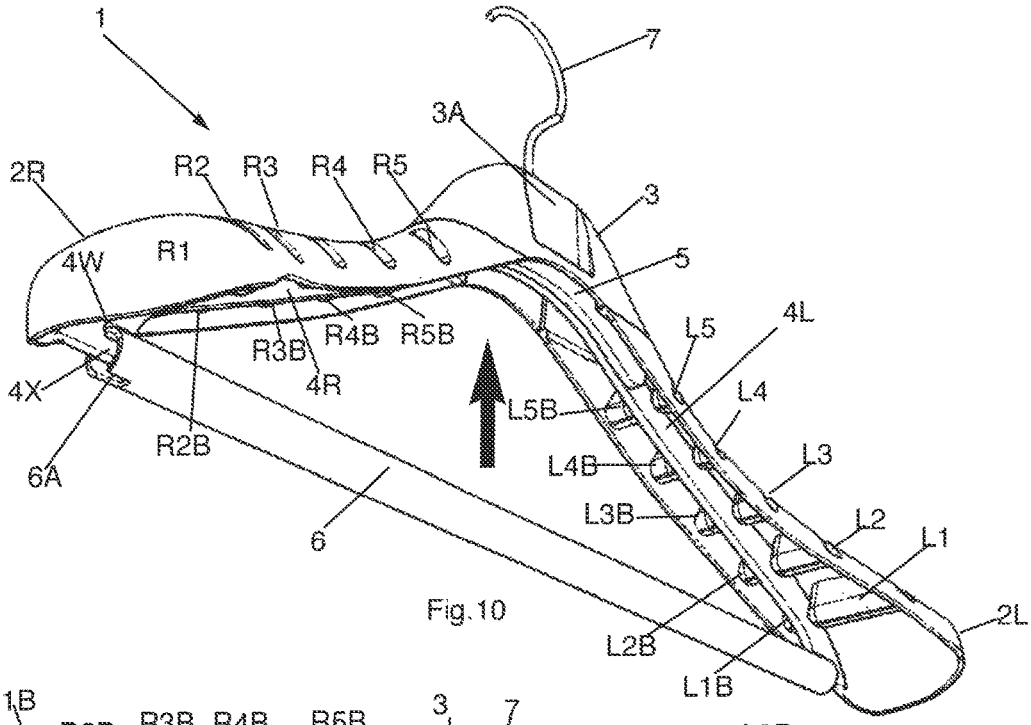
FIG. 10 shows from below, a Perspective view of the fully assembled hanger, and how the mainframe slots into the assembled outer shell.

FIG. 9 is an exploded view of the main elements, the neck-piece 3, the shoulders 2R,2L and the mainframe 4 completed with hook 7, and crossbar 6 prior to being brought together as a complete hanger 1. The completed Hanger 1 is seen in FIG. 10 from below, where the assembled mainframe 4 with hook 7 and crossbar 6 is inserted upwards, into the underside of the assembled top-section 3,2R,2L where the arms 4R,4L are slotted into the channel X-Y between the piers R1-R5, and R1B-R5B on the shoulder 2R, and the piers L1-L5 and L1B-L5B on the shoulder 2L. The centre-section 4A of the mainframe 4 fits into the neck-piece 3. The hook 7 attached to the mainframe 4 projects through the top of the neck-piece 3 through the aperture 3B, cut horizontally across the top surface of the neck-piece 3.

The mainframe 4 may be fixed to the top-sections 3,2R,2L very simply, either by gluing, by one or more staples, pins, ties or rivets or by a combination of one or more of those or other methods.

Figure 12:
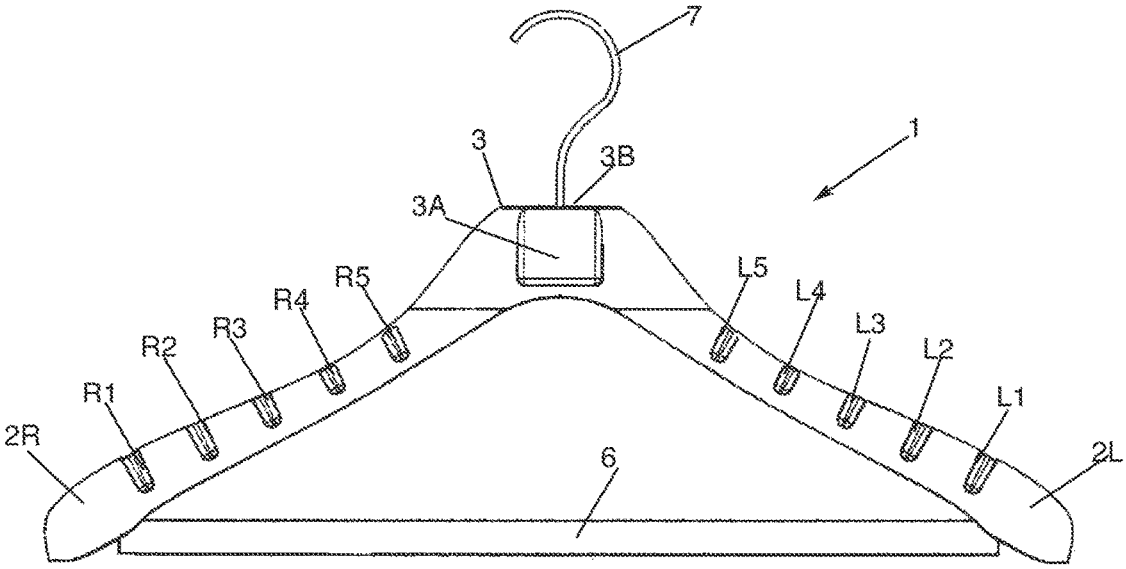
FIG. 12 is a front elevation of the fully assembled hanger.

FIG. 11 shows a plan view of the fully assembled hanger 1, and FIG. 12 shows the assembled hanger 1 in elevation.

FIGS. 13-20 show another method of attaching a metal hook to the planar mainframe 4. (This method can also be used to attach a hook to a substantially planar hanger with machinery developed to achieve this.)

Figure 13:
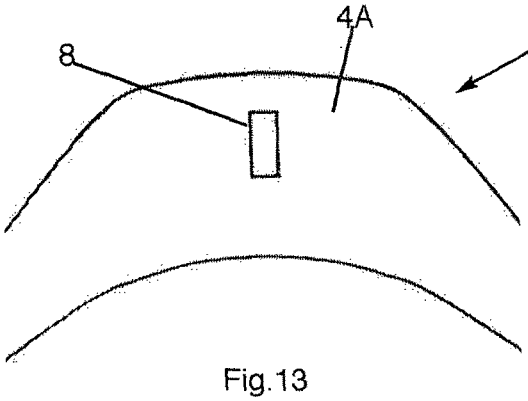
FIGS. 13-20 are schematic drawings showing how a special staple or flange which has been developed to hold a particular type of hook onto a substantially planar surface.
Figure 14:
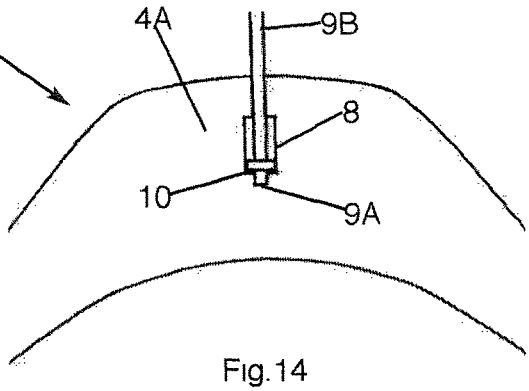
Figure 15:
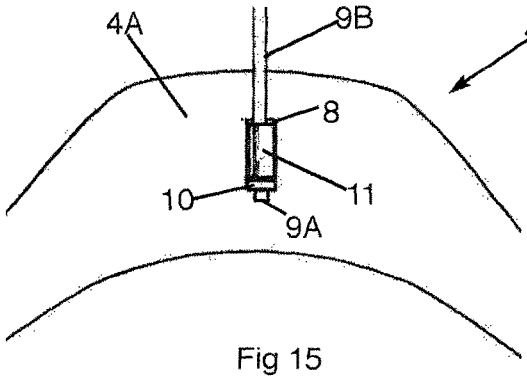
Figure 16:
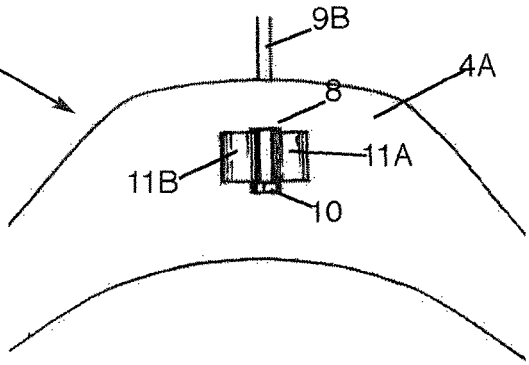
Figure 17:
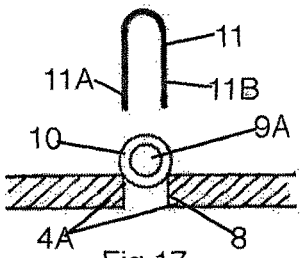
Figure 18:
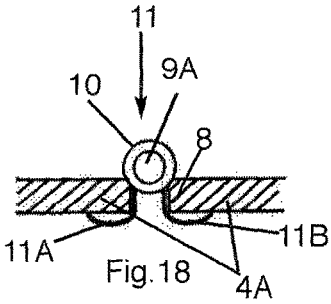
Figure 20:
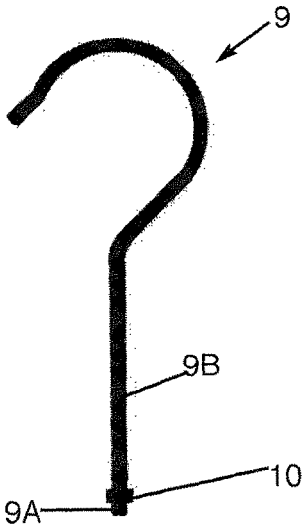
Figure 19:
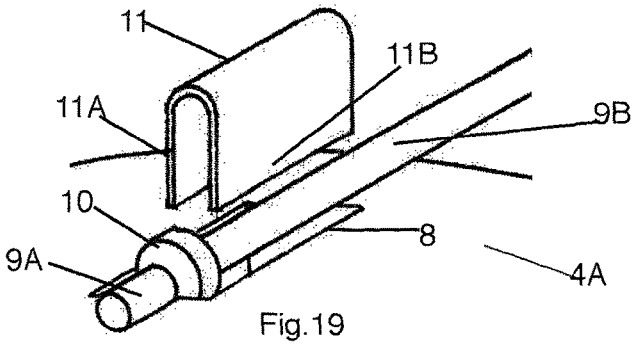

FIG. 20 shows another type of hook 9 formed with a small ring 10 extending outwards from the circumference of, and located near the base of the hook-shank 9B. A small section 9A of the hook-shank 9B extends a short distance beyond the ring 10. FIG. 13 shows the centre-section 4A of the mainframe 4, with a small rectangular aperture 8 cut into its centre a short distance from the top of the centre-section 4A. In FIG. 14 the small section of the hook-shank 9B which projects beyond the ring 10 is shown placed in situ, overlapping the bottom of the aperture 8. FIG. 15 shows in elevation how the flange or staple 11 is dropped on top of the hook-shank 9B, the length of the staple occupying the remaining space between the top of the aperture 8 and the top-surface of the ring 10. FIG. 16 shows the obverse of the centre 4A of the mainframe 4 with the 'legs' 11A, 11B of the staple 11 splayed outwards from the obverse of either side the aperture 8, to secure the hook 9 in situ. The process is shown again in FIGS. 17 and 18, from below, where in FIG. 17 the staple 11 is shown in position prior to being dropped (FIG. 18) onto the hook-shank 9B above the ring 10, the legs 11A,11B being splayed outwards to secure the hook 9 in position.

Figure 21:
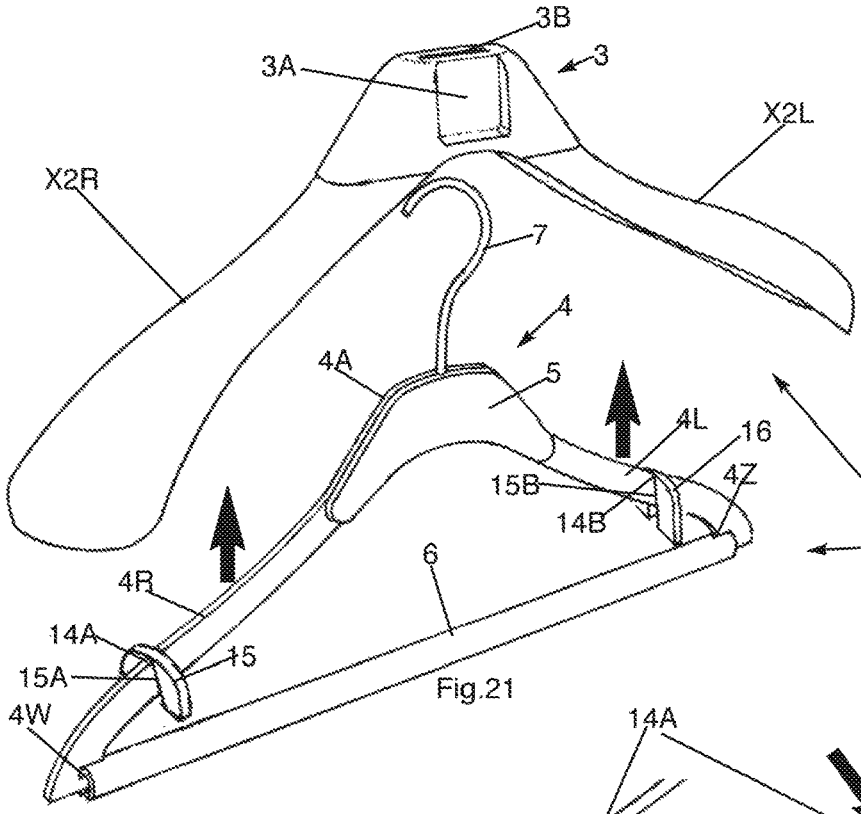
FIGS. 21-26 show an alternative construction for the apparatus.
Figure 22:
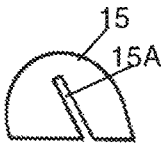
Figure 23:
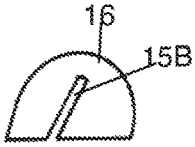
Figure 24:
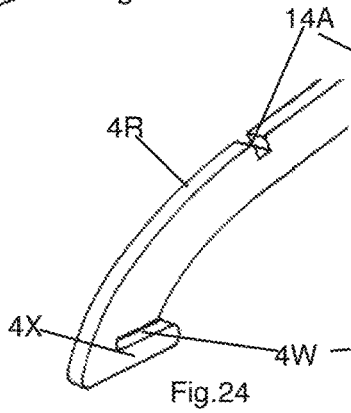
Figure 25:
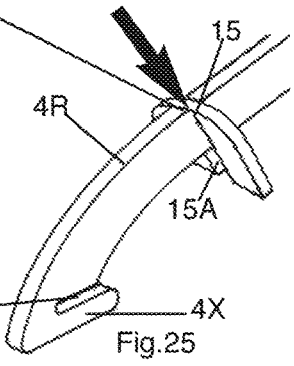
Figure 26:
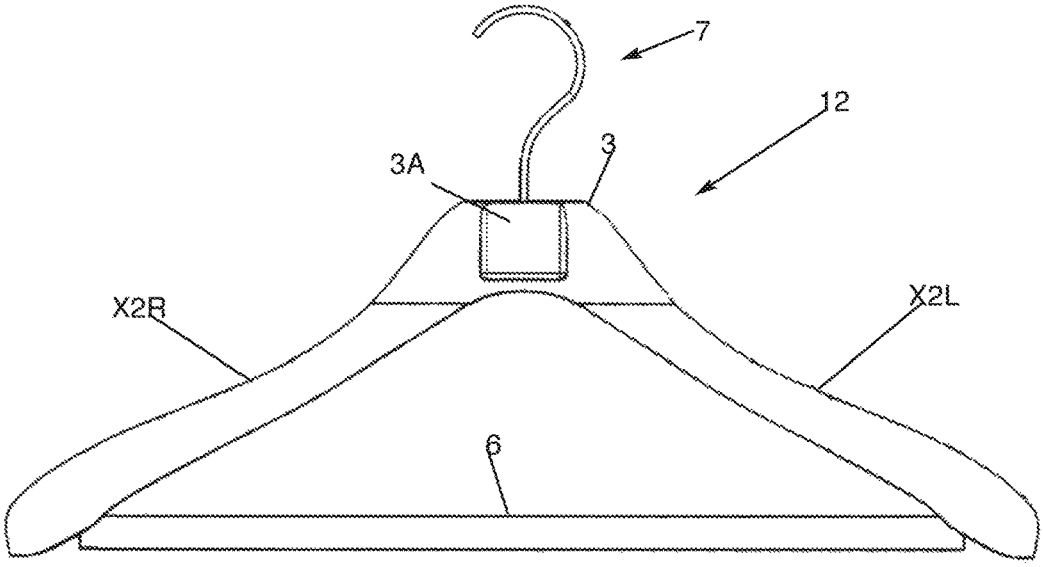

FIGS. 21-26 show an alternative construction for the hanger. In FIG. 21 the upper section X2R,3,X2L is shown prior to it's being joined to the mainframe 4,5 to form the complete hanger 12. In this version, the outer shell X2R,3, X2L is constructed in the same way as previously (FIGS. 9-10) except that the indents or flutes R1-R5, and R1B-R5B on the shoulder 2R, and the indents L1-L5 and L1B-L5B on the shoulder 2L (FIG. 11) are not featured in this version 12. Instead, the location of the mainframe, 4 within the upper shell X2R,3,X2L is achieved by means of stabilisers 15,16 fitted across and at right-angles to, the outer arms 4R,4L of the mainframe 4 by means of indents 14A,14B cut into the upper edge of the arms 4R,4L (FIG. 21) which allow the stabilisers 14A,14B to slide downwards via slits 15A,16A cut upwards into the stabilisers 14A,14B at their base, such that when fully in situ are flush with the top-edge of the arms 4R,4L (FIGS. 24,25). The stabilisers 15,16 are shaped to fit the cross-section of the arms X2R,X2L. (FIGS. 22,23). In this embodiment, two stabilisers 15,16 have been used; however, there may be more of these set at intervals along the length of the arms X2R,X2L. In all other respects the hanger 12 remains the same as the original embodiment 1.

It will be understood that both methods of locating the mainframe, i.e., using the indentures or flutes, may be combined with stabilisers to enhance strength.

As in the first embodiment 1 the mainframe 4 may be fixed to the top-sections X2R,3,X2L very simply, either by gluing, by one or more staples, pins, ties or rivets or by a combination of one or more of those or other methods. The fully assembled hanger 12 is shown in elevation in FIG. 26.

In FIGS. 27-33 another, similar development is shown whereby a substantially planar clothes-hanger 18 may be provided with shoulder-pieces 17R, 17L to provide a more substantial support and contoured shoulder-end.

Figure 27:
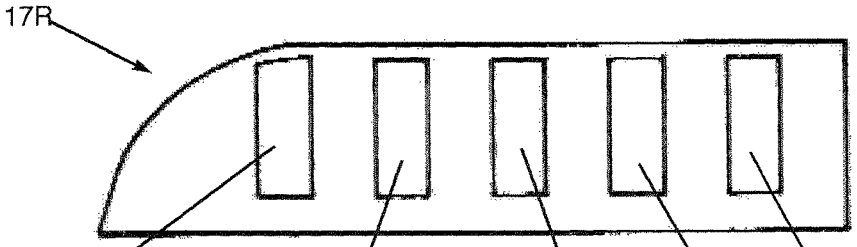
FIG. 27 shows a front elevation of an attachable shoulder-piece.
Figure 28:
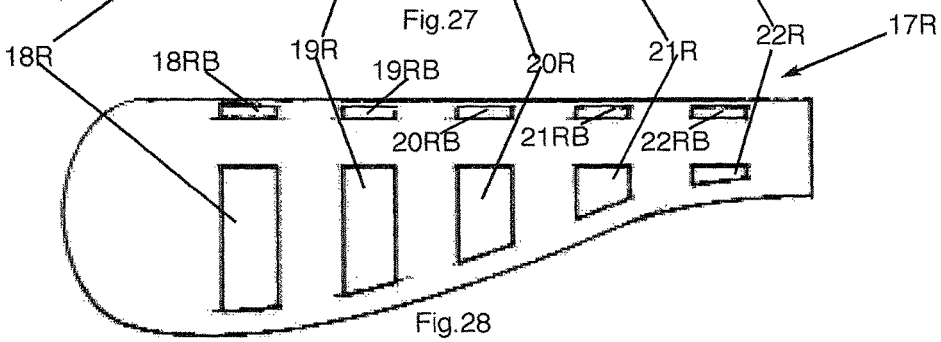
FIG. 28 shows the same shoulder-piece in plan view.
Figures 29, 29A:
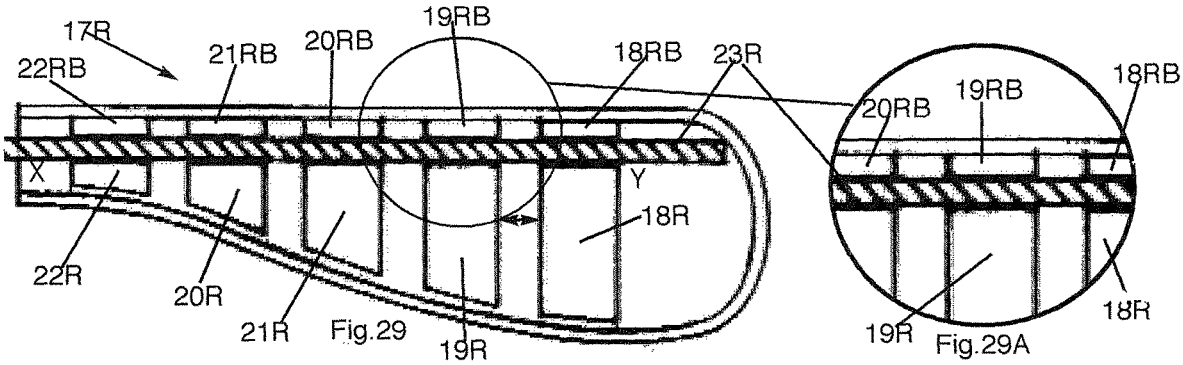
FIG. 29 shows the same viewed from below.
FIG. 29A is an enlarged view from a section of FIG. 29.

FIG. 27 shows in frontal elevation the shoulder-piece 17R in the form of a 'shell' punctuated at intervals along its length by a series of 'indents' 18R,19R,20R,21R,22R similar to the first embodiment (FIGS. 2-12). In FIG. 28 the plan view shows another set of indents 18RB, 19RB, 20RB, 21RB, 22RB, set on the back and immediately behind the indents 18R, 19R, 20R, 21R, 22R. FIG. 29 shows the view from below, where the indents 18R, 19R, 20R, 21R, 22R and 18RB, 19RB, 20RB, 21RB, 22RB become, within the shoulder-piece 17R, a series of 'buttresses' 18R, 19R, 20R, 21R, 22R and 18RB, 19RB, 20RB, 21RB, 22RB which face each other to form a channel, X-Y into which the hanger-arm 23R fits. It should be noted that in the present embodiment, although the channel X-Y is formed between TWO sets of buttresses 18R, 19R, 20R, 21R, 22R and 18RB, 19RB, 20RB, 21RB, 22RB, a similar channel may be created without the second, or back set of buttresses 18RB, 19RB, 20RB, 21RB, 22RB by the back wall of the shoulder-piece 17R.

Figure 30:
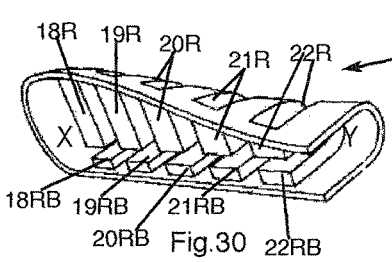
FIG. 30 shows the view from beneath in perspective/
Figure 31:
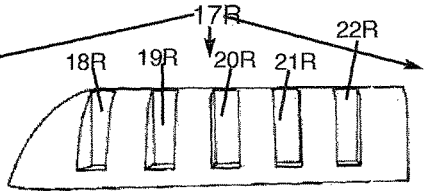
FIG. 31 shows the front elevation in perspective.
Figure 32:
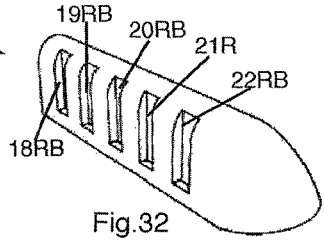
FIG. 32 shows the shoulder-piece from behind, in perspective.

FIGS. 30-31 show the shoulder-piece 17R in perspective. FIG. 30 shows the view from below, FIG. 31 shows the front, while FIG. 32 shows the back of the shoulder-piece 17R, with indents 18RB, 19RB, 20RB, 21RB, 22RB.

It will be understood that the opposite shoulder-piece 17L is exactly symmetrical with the one 17R here described.

Figure 33:
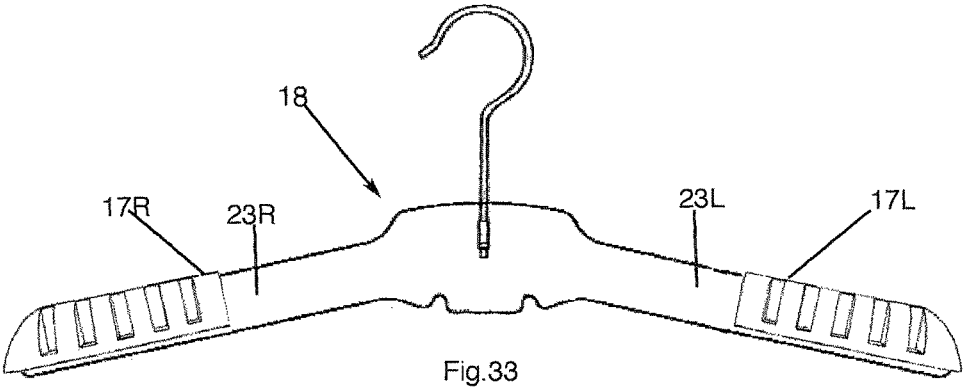
FIG. 33 shows a front-elevation of a planar hanger with the shoulder-pieces in situ.

FIG. 33 is a front elevation of the completed hanger 18 with shoulder-pieces 17R and 17L in situ.

Attachable Sleeves and Extensions for Increasing Width on Planar Hangers

FIG. 34 shows the sleeve 1 prior to folding with the five sections A, B, C, D, E divided by fold-lines W-W, X-X, Y-Y, Z-Z, and with tabs 4,5 cut out of the panel C, from apertures 4A and 5A and attached at fold-lines F-F and G-G respectively. These tabs, 4,5, have been set along the fold-line X-X, and at a short distance away from the opposite fold-line Y-Y, the gaps forming a 'gutter' within the sleeve 1 which will be occupied by the hanger arm 6R. FIG. 35 shows a perspective of the sleeve 1, where the initial folding has been started. FIG. 36 shows how the sleeve 1 may be folded and glued flat where the sleeve 1 folds along its length at fold-line X-X, where the outer panel A is folded inwards along fold-line W-W and beneath the opposite panel E to which it may be attached by being glued or stapled. In FIG. 37 the completed sleeve 1 is shown from the inner end in which the panel A is seen folded inwards and fixed to the panel E. FIG. 38 shows how the sleeve 1 may be deployed, by squeezing across the diagonal of the flattened sleeve 1 to open the sleeve 1 into a 'tube' format, prior to being attached (FIGS. 39-41) to the arm 6R of the hanger 6.

In FIG. 40 the sleeve 1 is shown prior to being attached to the hanger 6, and in FIG. 41 the sleeve 1 is shown having been slid onto the arm 6R of the hanger 6, and at the point where the tabs 4,5 are being pushed inwards, to fold along fold-lines F-F and G-G respectively through the apertures 4A,5A into the recess between the front surface of the hanger arm 6R and the inner wall of the front panel B of the sleeve 1 to force the said arm 6R against the back panel D of the sleeve 1. FIG. 42 shows a cross-section looking along the length of the sleeve 1 from the inner side and between the tabs 4,5, where the tab 4 is in the fully deployed (vertical) position, butting against both the hanger arm 6R and the inside of the outer panel B, and in FIG. 43 the deployment is seen in from the front through the outer front panel B of the sleeve 1, where the tab 4 is seen rotating along fold-line F-F to the vertical position within the sleeve 1. FIG. 44 shows a front view in perspective with both sleeves 1, 1L attached to the hanger 6.

FIG. 45 shows another type of hanger 7, which has a cross-bar 7B. FIG. 46 shows the layout of the sleeve 8 prior to folding. This sleeve 8 comprises six panels 8A,8B,8C, 8D,8E,8F divided along fold-lines H-H, J-J, K-K, L-L, M-M, and extending outwards from the outer panel 8F, two tabs 9,10 divide from panel 8F at fold lines P-P and N-N. FIG. 47 shows in perspective, the initial folding beginning. FIG. 48 shows how the sleeve 8 is formed into a rigid box format, where the panel 8A lies beneath the panel 8E butting against the front panel 8D to form a strong box with an inward-sloping front panel 8D caused by the base-panel 8C being made narrower than the panel 8A. At this point, (FIG. 49) the panel 8A may be attached below the top-surface panel 8E, by being glued, stapled or such, to simplify attaching the sleeve 8 to the hanger arm 7R. This, however, is not strictly necessary.

Again in FIG. 49, the sleeve 8 is shown 'wrapped' around the hanger arm 7R with said arm 7R being located between panels 8B and 8F, and the tabs 9,10 being folded along fold-lines P-P and N-N forwards beneath the arm 7R, to meet the slots 11,12 cut into the base panel 8C at corresponding positions along fold-line K-K. The slots 11,12 are cut slightly narrower than the tips of the tabs 9,10. The tabs 9,10 also fold at their outer tips along fold-lines R-R, S-S, at which point the tips of the tabs 9,10 have small extensions 9X, 9Y and 10X, 10Y, which when the tips of the tabs 9,10 are inserted into the slots 11,12 lock the tabs 9,10 into the slots 11,12.

FIG. 50 shows the positioning of the sleeve 8 from the back prior to locking, and FIG. 51 shows the same from the front. In FIG. 52 the tab 10 is shown locked into the slot 12, while the tab 9 is shown being pushed into the slot 11. FIG. 53 shows the sleeve 8 in the fully locked position. FIG. 54 shows the hanger 7 with both sleeves 8, 8L in situ.

FIG. 55 shows the layout of the 'tapered' sleeve 13 prior to folding and fixing/gluing. This sleeve 13 is similar to the first version of the sleeve 1, insofar as it consists of five panels AA, BB, CC, DD and EE, separated at fold-lines 1W-1W, 1X-1X, 1Y-1Y, 1Z-1Z, and is designed to be secured by pressure from an inward-pushed tab. This sleeve is fitted with such a tab 14 on its front panel DD, folding along fold-line V-V from aperture 14A. This sleeve 13 is folded in the same way as the first sleeve 1 and glued/fixed in the same format, except that it is tapered, increasing in width as it extends outwards. In FIG. 56 the completed sleeve 13 is shown prior to being slid onto the hanger arm 6R of the hanger 6. FIG. 57 shows the hanger 6 being fitted with the sleeve 13. In FIG. 58 the tab 14 is seen being pushed inwards through the aperture 14A, and into the recess between the front of the hanger arm and the front panel DD 6R to hit the surface of the hanger arm 6R, forcing it hard against the back panel BB of the sleeve 13. FIG. 59 shows the sleeve 13 fully deployed on the hanger arm 6R, and in FIG. 60 both sleeves 13, 13L are shown fully deployed on the hanger 6.

FIGS. 61-65 show a different approach to the same issue. Here the width is increased by doubling the thickness of the arm by folding over an extension of the arm itself. In FIG. 61 the hanger 15 is shown in elevation with arms 18R,18L having set below them, extensions 19R, 19L, separated by fold-lines A-A,B-B each extension 19R,19L being roughly symmetrical to the arms 18R, 18L above. FIG. 62 shows the lower sections 19R,19L as the begin folding upwards along fold-lines A-A,B-B, and in FIG. 63 we see the folding completed so that the lower sections 19R, 19L now lie flat along the surface of the arms 18R, 18L to provide the upper surface of each arm 18R,19R,18L,19L with double the width of the original material.

In FIG. 64 a tubular crossbar 17 has been attached to the small tab-extensions 20R,20L which protrude inwards from the outer ends of the arms 18R, 18L. The crossbar 17 has cut out from the circumference at one of the crossbar 17 (FIG. 65), a small aperture 17A, whereby when the crossbar 17 is located onto the extension tab 20L, the other end of the crossbar 17 engages with the opposite tab 20R through the aperture 17A, and is secured in situ by turning the crossbar 17 through 180 degrees to lock.

Provision of Top-Surface, and Information Window on Planar Clothes Hanger Arms

According to the present invention therefore, in FIG. 66, a central hook-section 1 is shown prior to folding along fold-line A-A as two sections, a hook-section 1F and a lower section 1B, each incorporating a small 'window' 8F, 8B. FIG. 67 shows the obverse where the lower section 1B is folded back and upwards along fold-line A-A to meet the obverse of the hook section 1F, and to lie flat against it (FIG. 3).

FIGS. 69&70 show the arm profiles, 2L and 2R with fold-lines B-B, C-C, D-D, E-E, and F-F, G-G, H-H, J-J separating panels 13-17, and 18-22 respectively.

FIGS. 71&72 show a tab 3, bearing information on both sides to display through the 'windows 8F,8B on the assembled centre-section 1.

FIGS. 73-75 show an alternative centre section 4 comprising two symmetrical panels 4F&4B separated by fold-line A-A, and minus the hook-extension on 1F as shown in FIGS. 66-68. FIG. 74 shows how an alternative hook 5, which may be metal, might be fitted between the two surfaces 4F&4B. The two surfaces 4F&4B would be pressed together and may be fixed by gluing or stapling or any other method, to hold the hook 5 compressed between the surfaces 4F&4B, by gripping the ringed 'shank' 5A at the hook 5 base.

Figure 76:
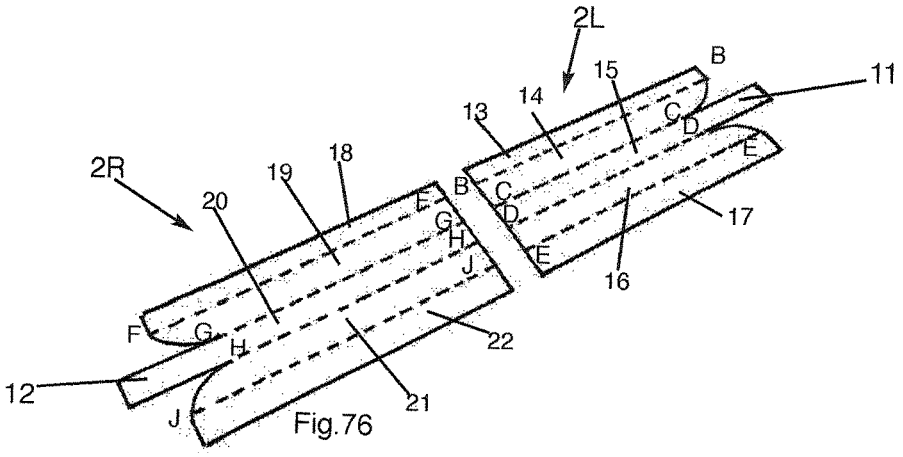
Figure 77:
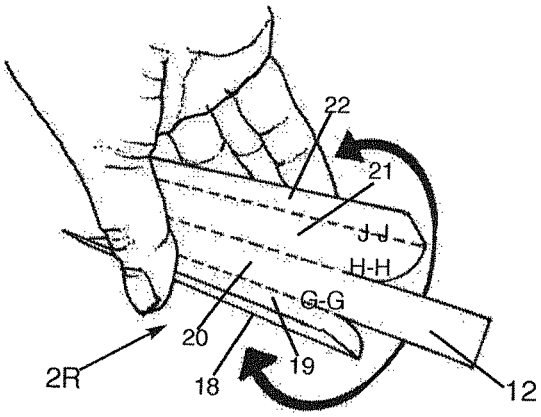
Figure 78:
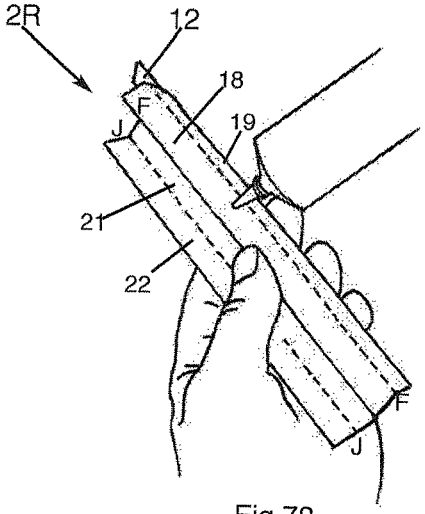

FIG. 76 shows in perspective the arm-profiles 2L&2R prior to folding along fold-lines B-B, C-C, D-D, E-E, and F-F, G-G, H-H, J-J respectively. FIGS. 77&78 show the inward-folding and fixing of the forms 2L&2R into a rectangular tube format. The fixing may be accomplished by gluing, stapling or locking. FIG. 77 shows the beginning of the folding process on the profile 2R, which is followed (FIG. 78) by the application of adhesive to the panel 18 which is then subsumed beneath, and fixed to, the panel 22 on the other edge of the profile 2R to complete the formation of the tube 2R.

Figure 79:
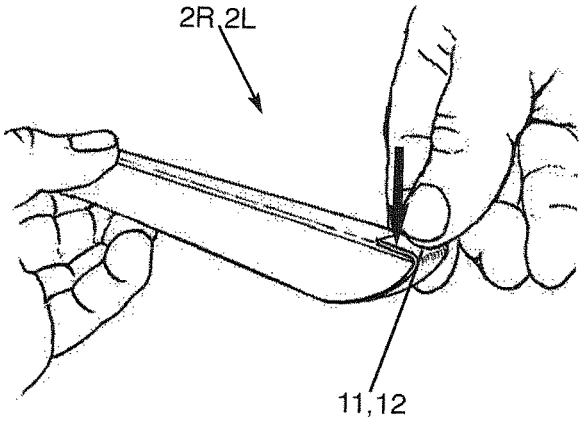

FIGS. 79&80 show how the tabs 11,12 are folded downwards and fixed below at the outer tips of the arms 2L&2R, to form a downward curve. The profile 2L is formed in the same way. FIG. 80A shows a cross-section through the arm 2R looking from the outer end, showing how the panels 18-22 are configured to form a tube.

FIG. 81 shows the three sections 1, 2L,2R completed and ready for assembly. It should be mentioned here that the two sections 1F,1B of the hook-section 1, may not require to be fixed together in any way, as the arms 2L,2R when attached to the extensions 9F,9B and 10F,10B, will hold the two sections 1F,1B firmly together, and allow the insertion of the information-tab 3, prior to attaching the opposite arm 2L.

In FIG. 82 the first arm 2R is slid onto the extension 10F,10B, to butt against the 'shoulders'S. located at the origins of the upper and lower edges of the extensions 9F,9B and 10F,10B, which itself will lock both parts 1F,1B of the centre section 1 together. In FIG. 83, prior to attaching the arm 2L, the information-tab 3 slides between the extensions 9F,9B to expose the information, (which may, as shown in this embodiment, relate to size), through the windows 8F, 8B, located on both sides 1F, 1B of the hook section 1. FIG. 86 shows the arm 2L being attached to the extension 9F,9B to complete the assembly (FIG. 87).

An alternate method of providing a top-surface X1 with a greater width is shown in FIGS. 88-91. Whereas in the previous embodiment 2R, the top surface panel 20 was in the centre of the profile 2R, between fold-lines G-G and H-H, thereby limiting the width of the top surface panel 15,20 to the dimensions of the box 2L,2R, in the new design X2L, X2R the top surface panel X1 now, not limited to the size of the box X2L,X2R extends outwards from fold-line K-K on the outside edge of the profile X2R. The profile X2L is exactly symmetrical with X2R. FIG. 22B shows a cross-section of the arm X2R viewed from the outer end, showing how the top surface panel X1 can now cantilever outwards horizontally along the length of the arm, from fold line K-K, and beyond the confines of the box formed by X1,X2,X3, X4,X5 to form a wider top-surface along the arm X2R.

FIG. 92 shows another profile 6 designed to form by folding and fixing into another version of a hanger 6 with a wider top-surface 8L,8R. In FIG. 23, the arrows indicate that the lower sections 7L,8L and 7R,8R are folded backwards beneath the profile 6, and upwards along fold-lines K-K and L-L respectively and attached along their length by gluing, stapling or by some means to the back of the arms 6L,6R of the main hanger 6. FIG. 93 shows the obverse of the folding where the panels 8L,8R are now showing above the hanger arms 6L,6R with the fold-lines M-M and N-N now lined up with and parallel to the top of the arms 6L,6R as seen in FIG. 94 where the hanger 6 is again shown from the front. The two top surface panels 8L,8R are now pushed downwards by 90 degrees over the top edge of arms 6L,7L and 6R,7R to project outwards at right-angles to the arms 6L,7L and 6R,7R.

At this stage, (FIGS. 95&96) an additional strengthening section 7 may be made to the centre of the hanger, which could be another hook and centre section 7X,7Y with small projections 7W,7E projecting outwards from the centre 7Y at the same angle and width as, and parallel to, the arms 6L,7L and 6R,7R of the main profile. This section 7 would be exactly the same shape as the hook and centre sections 23, 24 of the main profile 6 and would be fixed exactly over those sections 23, 24 by means of gluing, pins, staples or such. This, however would depend on the thickness and strength of the materials used in the making of the hanger 6, so that if the hanger 6 was made from a heavier material, the addition 7 may not be necessary. Additionally, the original profile 6, may be created without the hook 23, and a separate hook section 7 added to the profile 6.

FIG. 97 shows the outer end of the top surface 8R bent downwards along the top of the arm 6R with the tab 9R folded downwards along fold-line y-y and fixed by means of gluing, stapling or some such to the back surface of the arm 6R,7R. The same applies to the opposite arm 6L,7L with the top surface 8L being folded downwards at the outer end and fixed by tab 9L which folds down along fold-line x-x to attach to the back of the arm 6L,7L to hold the top-surfaces 8L,8R at the required right angle to the arms 6L,6R. FIG. 98 shows the completed hanger 6,7 with flat top surfaces 8L,8R. As with the previous embodiments 1,2L,2R and 1,X2L,X2R, the original hook panel 1F may be dispensed with to be replaced by a metal hook 5 as shown in FIGS. 73-75.

FIGS. 99-102 show an alternative information-tab insertion feature applied to the first embodiment shown in FIGS. 66-68.

In FIG. 99 the original central section 1, shown in FIGS. 66-68, has been modified to become 1XX, which although exactly the same in all respects to the section 1 shown in FIGS. 66-68, has had a small section Z1 removed from one side of the outer edge on panel 1B to allow an alternative information-tab 25 to be inserted when the two sections 1F,1B are folded together along fold-line A-A in the completed hanger 1XX, 2L,2R. FIG. 101 shows the completed hanger 1XX, 2L,2R with the information-tab 25 positioned to enter the access-slot Z1. In FIG. 102 the information-tab 25 is pushed home into the access-slot Z1 so that the information is visible through the window 8B on the panel 1B. Information on the obverse of the information-tab 25 will also be visible through the window 8F on panel 1F on other side of the hanger 1XX, 2L,2R. Unlike the first embodiment 1, 2L,2R shown complete in FIG. 22, this access Z1 does not require the arm 2L to be removed to allow the information tab 25 to be inserted.

Attaching a Standard Ringed Metal Hook to a Planar Clothes Hanger

FIGS. 103-112 show how a hook 5 with a 'ringed' shank 2 is attached and fixed between the identical profiles 1,3 of a two-layer hanger 1,3. FIG. 103 shows a perspective view of the ringed shank 2 of the hook 5. FIG. 104 shows a perspective view of one profile 1 of the hanger 1, with the centrally located aperture 4.

FIGS. 105&106 show where the hook 5 is located over the aperture 4 on the first layer 21. FIG. 106 shows a close-up where the ringed shank 2 of the hook 5 extends slightly past the lower end of the aperture 4. FIG. 107 shows the second profile 3 positioned prior to being attached to the first profile 1.

The profiles 1,3 may be attached by being glued, stapled or pinned, and are bought together (FIG. 108) under pressure, with the hook 5 located between the two, causing the hook-shank 2 to be pressed into the material of both hanger profiles 1,3 leaving the ringed section 2 visible through aperture 4 on the profile 1, and also through the aperture 6 on the profile 3 as shown in FIG. 109.

At this point, FIG. 110 shows how a setting material, 9, which may be glue, resin, mastic or such may be injected by an applicator 7 into both apertures 4,6 to engulf the ringed-shank 2 and cause it to be held firmly when the material coagulates. FIGS. 111&113 show how a staple 8 may be applied to provide additional strength and inhibit horizontal movement of the hook. FIG. 112 shows the completed hanger 1, 3 with the hook 5 in situ.

What is claimed is:

1. A clothes hanger comprising one or more elements that can be assembled to define a hanger shape for suspending a garment, comprising one of:

a moulded form made from pulp, in the shape of a clothes hanger comprising a plurality of indents or flutes set at intervals along one or both sides of hanger arms, which drop downwards into a body of said arms;

two moulded forms, in the shape of clothes hanger arms, extending outwards from a central point at which they are held together within and beneath a third moulded section to form a hanger shape, the two moulded forms comprising a plurality of indents or flutes set at intervals along one or both sides of the hanger arms, which extend into an interior of the clothes hanger arms to define piers for gripping a planar hanger form therein;

moulded forms, which assemble to form a hanger shape, hanger arms of which are indented by a plurality of indents or flutes set at intervals along one or both sides of the hanger arms, and which drop downwards into the body of said hanger arms; and a moulded hanger form wherein a plurality of indents or flutes formed on one or both sides of a hanger arm drop downwards into the body of the hanger arm to form a line of piers inside the body of said hanger arm, which form a channel which runs along an inside of the hanger arm;

wherein the indents or flutes, form within the body of the clothes hanger, a series of piers set at intervals to form a channel running the length of the said hanger, wherein:

a planar armature or former, cut from a paper-based or fiber-board based material to the same format and dimensions of the said channel, is set into the channel either between inner vertical surfaces of two rows of piers, or if the piers are only on one side of the shoulder-piece, between inner vertical surfaces of said piers and the opposite outer wall of the shoulder-piece;

to provide support for the outer hanger form.

2. A clothes hanger according to claim 1, wherein:

the planar armature or former, set within the channel is provided with a wire-based hook set centrally on the planar former or former and held in situ by being sandwiched between the planar former and another smaller planar piece of material of similar thickness to the said planar former which is fixed against the planar former by gluing, or stapling.

3. A clothes hanger according to claim 2 wherein:

the wire-based hook set into the planar former, projects upwards through the top of the central section of the outer hanger form.

4. A clothes hanger according to any of the claims 1, 2 or 3 further comprises a tubular crossbar, wherein:

the tubular crossbar is attached to the assembled clothes hanger by means of being plugged into inwardly-projecting spurs set horizontally into each of the outer ends of the inner surface of the planar former.

5. A clothes hanger comprising elements that can be assembled to define a hanger shape for suspending a garment, comprising:

a moulded form made from pulp in the shape and format of a clothes hanger;

a substantially planar armature or former, cut from a paper-based or fiber-board based material to conform to the shape and inner dimensions of said moulded form, and set within a body of said moulded form, held in situ by means of two or more planar slotted stabilisers which attach to the planar former or armature by means of slots of the stabilisers and which are fitted across respective arms of the moulded form to fit an inner surface of the arms, wherein an outer form of the armature or former conforms to an inner contour of the moulded form and the armature or former is fixed within the moulded form at set intervals by gluing, pins or staples.

6. A substantially planar clothes hanger provided with at least one moulded shoulder piece, comprising:

at least one moulded form made from pulp conforming to a shoulder-shape providing the at least one moulded shoulder piece, provided with a series of indents or flutes running along one or both sides of the shoulder-piece, and dropping into the inside of the shoulder-piece to create a line of piers which form a channel running the length of said shoulder-piece, either between the two rows of piers, or if the piers are only on one side of the shoulder-piece, between the inner vertical surfaces of said piers and an opposite outer wall of the shoulder-piece;

a substantially planar clothes hanger made from a paper-based or fiber-board based material provided with the said shoulder-pieces attached by inserting upper edges of outer arms of the clothes hanger into the channel created by the piers, and fixed either by their own grip, or by gluing, or stapling.

7. A clothes hanger, comprising:

a substantially planar clothes hanger made from a paper-based or fiber-board based material including an aperture;

a wire-based hook, having a flange around the base of a shank of the, attached to the substantially planar clothes hanger; and a bracket which collars the shank above the flange and has legs extending through the aperture in the planar clothes hanger, said aperture extending to accommodate at a base of the aperture, the flange on the shank of the hook, and above the flange, corresponding to a vertical height of the bracket, such that when the legs of the said bracket extend through the aperture on the hanger, and are splayed outwards on the obverse surface of the hanger, the hook is made secure in its place.

* * * * *